US007319828B2

(12) United States Patent
Takesawa et al.

(10) Patent No.: US 7,319,828 B2
(45) Date of Patent: Jan. 15, 2008

(54) DEVELOPING AGENT DETECTING MECHANISM SECTION OF DEVELOPING APPARATUS

(75) Inventors: Yohichi Takesawa, Osaka (JP); Shigeki Hayashi, Nara (JP); Eiichi Kido, Nara (JP); Toshio Nishino, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 195 days.

(21) Appl. No.: 11/175,025

(22) Filed: Jul. 6, 2005

(65) Prior Publication Data

US 2006/0188273 A1 Aug. 24, 2006

(30) Foreign Application Priority Data

| | | |
|---|---|---|
| Jul. 14, 2004 | (JP) | 2004-207459 |
| Aug. 24, 2004 | (JP) | 2004-244136 |
| Sep. 29, 2004 | (JP) | 2004-284795 |
| Oct. 25, 2004 | (JP) | 2004-309846 |

(51) Int. Cl.
*G03G 15/08* (2006.01)

(52) U.S. Cl. ..... 399/27; 399/256

(58) Field of Classification Search ..... 399/27, 399/254, 263, 256

See application file for complete search history.

(56) References Cited

U.S. PATENT DOCUMENTS

| | | | | |
|---|---|---|---|---|
| 4,739,907 A | | 4/1988 | Gallant | |
| 5,025,287 A | * | 6/1991 | Hilbert | 399/254 |
| 5,124,752 A | * | 6/1992 | Kanno et al. | 399/256 |
| 5,235,389 A | * | 8/1993 | Kikuchi et al. | 399/263 |
| 5,264,900 A | * | 11/1993 | Momiyama et al. | 399/256 |
| 5,465,140 A | * | 11/1995 | Nakamura et al. | 399/254 |
| 5,579,094 A | * | 11/1996 | Behe et al. | 399/263 |
| 5,659,859 A | * | 8/1997 | Kikuta et al. | 399/256 |

(Continued)

FOREIGN PATENT DOCUMENTS

JP 56-66884 A 6/1981

(Continued)

*Primary Examiner*—Susan Lee
(74) *Attorney, Agent, or Firm*—Nixon & Vanderhye, P.C.

(57) ABSTRACT

A development apparatus includes an auger conveyor member for stirring and conveying developer, the gravity of the developer being eccentrically distributed with respect to a center of rotation, a drive transfer member for driving and rotating the auger conveyor member, the drive transfer member being capable of being engaged and disengaged, and a rotation detector for detecting a rotational state of the auger conveyor member. The remaining amount of the developer is detected based on the rotational state detected by the rotation detector. Alternatively, a development apparatus includes the auger conveyor member and the drive transfer member, in which the eccentric gravity distribution is achieved by a rod-like weight member eccentrically provided with respect to a rotational axis, the auger conveyor member includes a first coil spring having an inner diameter larger than an outer diameter of the weight member, and the first coil spring is inserted around the weight member in a manner which allows the first coil spring to be rotated and limits an angle of rotation of the first coil spring to a predetermined angle. Alternatively, a development apparatus includes the auger conveyor member and the drive transfer member, in which the auger conveyor member is provided near a development supply roller, and a uniforming member for making the developer uniform is provided in a space portion between the development supply roller and the auger conveyor member.

34 Claims, 16 Drawing Sheets

U.S. PATENT DOCUMENTS

| | | | | |
|---|---|---|---|---|
| 6,868,239 | B2 | 3/2005 | Inoue et al. | 399/27 |
| 7,139,505 | B2 * | 11/2006 | Askren et al. | |
| 7,177,567 | B2 * | 2/2007 | Miller | 399/263 |
| 2005/0264645 | A1 * | 12/2005 | Seto et al. | |

FOREIGN PATENT DOCUMENTS

| | | | | |
|---|---|---|---|---|
| JP | 57-68250 | U | | 4/1982 |
| JP | 57-189192 | A | | 11/1982 |
| JP | 60-110847 | U | | 7/1985 |
| JP | 62-184564 | U | | 11/1987 |
| JP | 1-109379 | A | | 4/1989 |
| JP | 1-2811477 | A | | 11/1989 |
| JP | 2-5769 | U | | 1/1990 |
| JP | 2-272472 | A | | 11/1990 |
| JP | 3-172875 | A | | 7/1991 |
| JP | 6-187880 | A | | 8/1994 |
| JP | 08062980 | A | * | 3/1996 |
| JP | 9-15953 | | | 1/1997 |
| JP | 11-174842 | A | | 7/1999 |
| JP | 2000-284594 | A | | 10/2000 |
| JP | 2001-194883 | A | | 7/2001 |
| JP | 2002-108086 | | | 4/2002 |
| JP | 2002268360 | A | * | 9/2002 |
| JP | 2004-12893 | | | 1/2004 |
| JP | 2004-012893 | A | | 1/2004 |
| JP | 2004-302338 | | | 10/2004 |

* cited by examiner

FIG.5 (a)
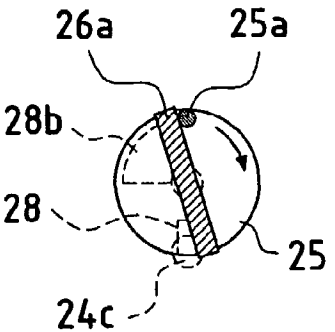
FIG.5 (b)
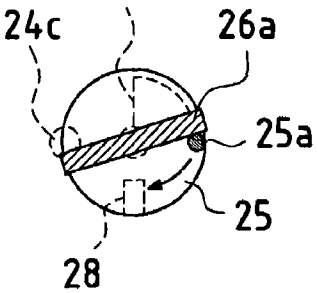
FIG.5 (c)
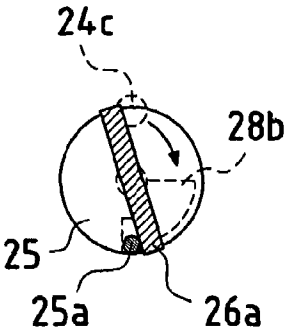
FIG.5 (d)
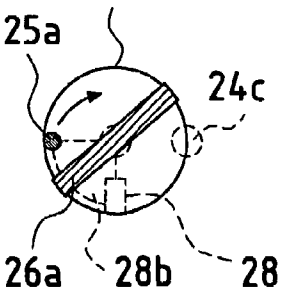
absence of toner
FIG.5 (e)
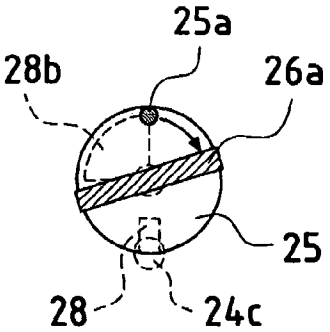
FIG.5 (d')
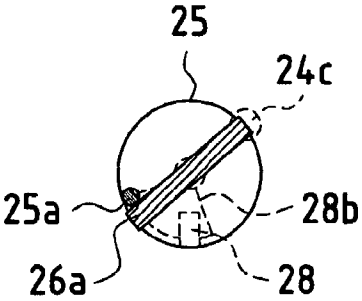
presence of toner
FIG.5 (e')
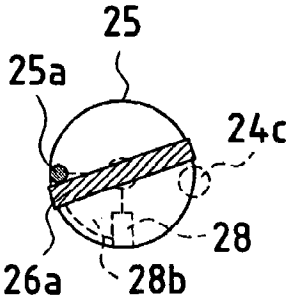

photodetector 28 output

FIG.8(a) presence of toner

FIG.8(b) absence of toner

DEVELOPING AGENT DETECTING MECHANISM SECTION OF DEVELOPING APPARATUS

BACKGROUND

This application claims priority under 35 U.S.C. § 119(a) on Patent Application No. 2004-207459 filed in Japan on Jul. 14, 2004, Patent Application No. 2004-244136 filed in Japan on Aug. 24, 2004, Patent Application No. 2004-284795 filed in Japan on Sep. 29, 2004, and Patent application No. 2004-309846 filed in Japan on Oct. 25, 2004, the entire contents of which are hereby incorporated by reference.

The present invention relates to a development apparatus having a function to detect the remaining amount of a developer remaining in a development tank.

Development apparatuses need to be replaced with new ones when a developer is exhausted in a development tank. Therefore, the development apparatus is provided with a developer detecting mechanism for detecting the remaining amount of the developer held in the development tank.

As a technique relating to such a developer detecting mechanism, a developer detecting mechanism illustrated in FIG. 17 is known in the art (see, for example, JP 2004-12893A).

The developer detecting mechanism includes a toner stirring member 901 having a shape of substantially squared-C which transfers to a development roller (not shown) a developer (hereinafter referred to as a "toner") held in a development tank (hereinafter referred to as a "toner tank") 900, a rotating shaft 902 which supports the member 901 at an end thereof, and a gear 903 which rotates the rotating shaft 902 with external force.

Further, at the other end of the toner stirring member 901, a slit plate 905 which passes through a photosensor 904 is provided. The slit plate 905 is a disk having a plurality of slits. In the photosensor 904, a light emitting section and a light detecting section are disposed facing each other, and the slit plate 905 passes in between. Therefore, the light detecting section of the photosensor 904 is turned ON when a slit of the slit plate 905 passes through the photosensor 904 (receives light from the light emitting section).

In the toner tank 900, the substantially squared-C-shaped toner stirring member 901 is rotated to stir the toner and convey a portion of the toner to the development roller. When stirring, the toner stirring member 901 entering the toner (toner accumulation) held in the toner tank 900 receives resistance due to the toner, so that the rotational speed of the toner stirring member 901 is slowed at a moment. Therefore, the speed of the slit plate 905, which is rotated along with the toner stirring member 901 and passes through the photosensor 904, is slowed. Therefore, the cycle of light detection by the photosensor 904 (corresponding to a cycle in which the slit passes through the photosensor 904) is elongated.

On the other hand, when the toner stirring member 901 leaves the toner held in the toner tank 900, the resistance of the toner suddenly disappears, so that the rotational speed is increased at a moment. Therefore, the speed of the slit plate 905 passing through the photosensor 904 is similarly increased, so that the light detection cycle of the photosensor 904 is shortened.

A time from entering to leaving the toner of the toner stirring member 901 is decreased with a decrease in the amount of the toner held in the toner tank 900 (toner remaining amount). Therefore, the toner tank 900 estimates the toner remaining amount by monitoring a change in the light detection cycle of the photosensor 904.

In most printed images on recording paper, pixels are generally concentrated on a middle portion of the recording paper more than on an edge portion thereof. Therefore, the toner of the toner tank 900 is consumed in the middle portion thereof more than in both edge portions thereof, so that the toner level in the toner tank 900 becomes uneven as a whole, leading to occurrence of irregular density in printing.

However, in the above-described conventional developer detecting mechanism, the toner is only stirred in the toner tank 900 using the toner stirring member 901. Thus, the conventional developer detecting mechanism does not have an ability to convey the toner to a lateral direction. In other words, the conventional developer detecting mechanism does not have an ability to cause the toner level in the toner tank 900 to be uniform in an entire width direction of the toner tank 900. Therefore, when there occurs an extreme difference in the toner level between the middle portion and the edge portion of the toner tank 900, an error may occur in detection of the toner remaining amount and the detection accuracy may be insufficient.

Example embodiments of the are devised to solve the above-described problems. An object of an example embodiment is to provide a development apparatus having a high-detection-precision developer detecting mechanism which has both an ability to convey toner and an ability to stir the toner. Such a developer detecting mechanism is achieved by eccentrically distributing the gravity of developer by stirring and conveying toner to provide a function as a toner stirring member of the conventional technique.

SUMMARY

In order to achieve the above-described object, a development apparatus according to an example embodiment includes an auger conveyor member for stirring and conveying developer (e.g., toner), the gravity of the developer being eccentrically distributed with respect to a center of rotation, a drive transfer member for driving and rotating the auger conveyor member, the drive transfer member being capable of being engaged and disengaged, and a rotation detector for detecting a rotational state of the auger conveyor member. The remaining amount of the developer is detected based on the rotational state detected by the rotation detector.

According to the development apparatus of an example embodiment, the auger conveyor member for stirring and conveying developer, the gravity of the developer being eccentrically distributed with respect to a center of rotation, the drive transfer member for driving and rotating the auger conveyor member, the drive transfer member being capable of being engaged and disengaged, and the rotation detector for detecting a rotational state of the auger conveyor member are provided. Thereby, the powder pressure of the developer in a development tank is made uniform, and a surface of the toner is consistently made flat, resulting in maintenance of satisfactory image quality and high-precision detection of the remaining amount of the developer.

According to the development apparatus thus constructed, the gravity of the developer is eccentrically distributed with respect to the center of rotation. For example, the auger conveyor member may be composed of a rotational axis and a conveying blade provided helically around the rotational axis. A rod-like eccentric column which is provided in parallel with the rotational axis may be attached to a peripheral end portion of the conveying blade. Specifically, the eccentric column may be fixed to a plurality of points of the peripheral end portion of the conveying blade at predetermined intervals corresponding to a helical pitch of the conveying blade.

The drive transfer member may have a clutch structure which can be engaged and disengaged and can transfer external force (rotational force) to the rotational axis of the auger conveyor roller. Specifically, when the eccentric column is rotated by 180 degrees in one direction from a lowermost position to an uppermost position, a transferring mechanism portion for transferring external force is engaged with and pushes in one direction a transferred mechanism portion which is provided closer to the rotational axis and receives the external force, so that the rotational force is transferred from the transferring mechanism portion to the transferred mechanism portion. On the other hand, when the eccentric column is slightly further rotated in one direction from the uppermost portion, the rotational speed of the auger conveyor member may be increased due to the eccentric load of the eccentric column. In other words, when the eccentric column is rotated in one direction to the lowermost portion after reaching the uppermost portion, the rotational speed of the auger conveyor member due to the eccentric load of the eccentric column is made faster than the rotational speed due to the external force. As a result, the engagement between the transferring mechanism portion for transferring external force and the transferred mechanism portion provided closer to the rotational axis is released.

Such a difference in the rotational speed, i.e., a difference between the rotational speed of the auger conveyor member when the eccentric column is rotated from the lowermost portion to the uppermost portion in one direction by 180 degrees, and the rotational speed of the auger conveyor member when the eccentric column is rotated from the uppermost portion to the lowermost portion in one direction by 180 degrees, is generated when there is substantially no developer left in a development tank. When there is a sufficient amount of developer left in the development tank, the difference is not generated. In other words, when there is a sufficient amount of developer left in the development tank, so that the auger conveyor member is buried in the developer, the load of the developer is applied to the eccentric column. Therefore, even when the eccentric column is slightly further rotated in one direction from the uppermost portion, so that the eccentric load of the eccentric column is applied to the auger conveyor member, a load which can cancel the eccentric load is applied from the developer to the eccentric column. As a result, also during a time when the eccentric column is rotated by 180 degrees in one direction from the uppermost portion to the lowermost portion, the transferring mechanism portion for transferring the external force is engaged with and pushes down in one direction the transferred mechanism portion provided closer to the rotational axis, so that the rotational force is transferred. In other words, when there is a sufficient amount of developer left in the development tank, the auger conveyor member is consistently rotated with a predetermined rotational speed irrespective of the load of the eccentric column.

As can be seen from the foregoing description, the auger conveyor member has a rotational speed pattern corresponding to one cycle of rotation, which varies depending on the remaining amount of a developer in the development tank. Therefore, by using the rotation detector to detect the rotational speed pattern, the remaining amount of the developer can be detected. In the above-described structure, the rotation detector is provided in the auger conveyor member. The auger conveyor member may have an ability to convey the developer in the development tank, for example, from both end portions to a middle portion thereof. In this case, the powder pressure of the developer in the development tank is made uniform and a surface of the developer is consistently made flat. Therefore, it is possible to maintain satisfactory image quality and detect the remaining amount of a developer with high precision without occurrence of a detection error which is a problem with conventional techniques.

In the above-described structure, the auger conveyor member may be disposed above the development supply roller. With such an arrangement, the powder pressure of the developer can be made uniform in the vicinity of the development supply roller and in the vicinity of the developer layer thickness limiting member (layer thickness limiting blade), resulting in a stable operation. The rotation detector may generate a plurality of output pulses per cycle of rotation of the auger conveyor member. Thereby, the remaining amount of the developer can be detected with higher precision.

In the above-described structure, one or more second auger conveyor members which are different from the auger conveyor member may be provided. In this case, the second auger conveyor member stirs and conveys the developer in a direction opposite to an auger conveyor direction of the auger conveyor member. By setting the conveying direction to be opposite to the conveying direction of the auger conveyor member whose gravity is eccentrically distributed, the powder pressure of the developer can be made more uniform, and a top surface of the developer can be made flatter, thereby making it possible to further improve image quality and remaining amount detection precision. For example, by providing the second auger conveyor member in parallel with the auger conveyor member, the powder pressure of the developer in the development tank is made even more uniform and the surface of the development agent is made even flatter, thereby making it possible to maintain image quality more satisfactorily and detect the remaining amount of the developer with higher precision.

In an example embodiment, as means of achieving the eccentric gravity distribution, a rod-like weight member (e.g., a stainless steel shaft) may be eccentrically disposed and fixed with respect to the rotational axis, without using an eccentric column. In this case, the auger conveyor member may be composed of a helical member having an inner diameter larger than an outer diameter of the stainless steel shaft, and the helical member may be rotatably inserted around the stainless steel shaft, thereby stirring and conveying developer. As the helical member, a coil spring can be used. The powder pressure of developer in the development tank is made uniform and the surface of the developer is made flat, thereby making it possible to maintain satisfactory image quality and detect the remaining amount of the developer with high precision.

When the developer (toner) is stirred and conveyed using a stirring blade (screw), the fluidity of the developer may be reduced due to a change in humidity, so that packing or compaction of the developer may occur around the screw, likely leading to an insufficient supply of the toner, an increase in stirring drive torque, locking of a stirring/driving system, damage on the drive system due to the locking, and the like. In contrast, when the coil spring having a play is used to stir and convey the developer as in an example embodiment, the coil spring can be moved in a radial direction. Therefore, the developer which is located around the helix and may cause compaction is removed by rotation without retention, thereby making it possible to prevent adverse effects, such as packing and compacting, resulting in a highly reliable development operation. In addition, if the stainless steel shaft is not provided, the coil spring is bent and deformed due to the load of the developer in association with rotation drive, so that the coil spring may contact with an inner wall of a housing, leading to a failure. With the above-described structure, the stainless steel shaft limits the deformation, thereby making it possible to achieve a highly reliable operation.

In the above-described structure, the helical member (e.g., the coil spring) may be composed of a plurality of separate members having different winding directions. For example, the helical member may be composed of two coil springs which are separated at a middle portion of the stainless steel shaft and have right-hand and left-hand winding directions. With the two coil springs having the opposite winding directions, the developer in the development tank is, for example, transferred from both ends to the middle portion as if the developer were collected together, so that the powder pressure of the developer in the development tank is made uniform and the surface of the developer is consistently made flat. Therefore, it is possible to maintain satisfactory image quality and detect the remaining amount of the developer with high precision without occurrence of a detection error which is a problem with conventional techniques. If the above-described screw is used to achieve a stirring function (a function to loosening agglomerated toner), a conveying force may be excessively strong so that a thickness of the developer is likely to become excessively high at the middle portion. In contrast, the coil spring has a high degree of freedom for setting a stirring force and a conveying force, thereby making it possible to easily solve such a problem.

In the above-described structure, the helical member (e.g., the coil spring) may be inserted around the stainless steel shaft, leaving a clearance which allows the helical member to be moved in a thrust direction. By inserting the helical member around the stainless steel shaft, leaving such a clearance, even when the coil spring is stretched and deformed due to the load of the developer or the like, the clearance can absorb the deformation, thereby making it possible to prevent a failure due to contact of the stretched coil spring with a side wall. The same effect can be effectively obtained when a plurality of coil springs (described in detail in embodiments below) or a single coil spring having a length which is substantially the same as a developed image width is used. Further, in this case, both end portions of each coil spring may be tightly wound around the stainless steel shaft. By tightly winding, adjacent end portions of the plurality of coil springs can be prevented from accidentally entangling each other. In addition, the end portions of the plurality of or single coil spring can be prevented from scratching the inner wall of the housing when the coil spring is slid to rub the inner wall of the housing.

In order to achieve the above-described object, another development apparatus according to an example embodiment includes an auger conveyor member for stirring and conveying developer, the gravity of the developer being eccentrically distributed with respect to a center of rotation, and a drive transfer member for driving and rotating the auger conveyor member, the drive transfer member being capable of being engaged and disengaged. The eccentric gravity distribution is achieved by a rod-like weight member eccentrically provided with respect to the rotational axis. The auger conveyor member includes a first coil spring having an inner diameter larger than an outer diameter of the weight member. The first coil spring is inserted around the weight member in a manner which allows the first coil spring to be rotated and limits an angle of rotation of the first coil spring to a predetermined angle. In this structure, the first coil spring may be able to be moved in a radial direction with respect to the weight member by a difference between the outer diameter of the weight member and the inner diameter of the first coil spring.

According to the development apparatus of an example embodiment, the auger conveyor member for stirring and conveying developer, the gravity of the developer being eccentrically distributed with respect to a center of rotation, and the drive transfer member for driving and rotating the auger conveyor member, the drive transfer member being capable of being engaged and disengaged, are provided. Therefore, the powder pressure of the development agent in the development tank is made uniform and the surface of the developer is made flat. Therefore, it is possible to maintain satisfactory image quality and detect the remaining amount of the developer with high precision. As means of achieving the eccentric weight distribution, the rod-like weight member eccentrically provided with respect to the rotational axis is used. The auger conveyor member includes the first coil spring (helical member) having the inner diameter larger than the outer diameter of the weight member. The first coil spring is inserted around the weight member in a manner which allows the first coil spring to be rotated with the predetermined angle to stir and convey the developer. Thereby, the powder pressure of the development agent in the development tank is made uniform and the surface of the developer is made flat. Therefore, it is possible to maintain satisfactory image quality and detect the remaining amount of the developer with high precision.

According to the thus-constructed development apparatus, the gravity of the developer is eccentrically distributed with respect to the center of rotation of the rotational axis. For example, the eccentric gravity distribution is achieved by the rod-like weight member eccentrically disposed and fixed with respect to the rotational axis. The rod-like weight member is specifically a stainless steel shaft formed in the shape of a crank. The first coil spring may be inserted around the stainless steel shaft in a manner which allows the first coil spring to be rotated and limits an angle of rotation of the first coil spring to a predetermined angle. In this case, the stainless steel shaft serves as an eccentric column which is deviated from the center of rotation of the rotational axis.

The drive transfer member may have a clutch structure which can be engaged and disengaged and can transfer external force (rotational force) to the rotational axis of the stainless steel shaft. Specifically, when the stainless steel shaft (eccentric column) is rotated by 180 degrees in one direction from a lowermost position to an uppermost position, a transferring mechanism portion for transferring external force is engaged with and pushes in one direction a transferred mechanism portion which is provided closer to the rotational axis and receives the external force, so that the rotational force is transferred from the transferring mechanism portion to the transferred mechanism portion. On the other hand, when the stainless steel shaft (eccentric column) is slightly further rotated in one direction from the uppermost portion, the rotational speed of the stainless steel shaft may be increased due to the eccentric load of the stainless steel shaft. In other words, when the stainless steel shaft is rotated in one direction to the lowermost portion after reaching the uppermost portion, the rotational speed of the stainless steel shaft due to the eccentric load of the stainless steel shaft is made faster than the rotational speed due to the external force. As a result, the engagement between the transferring mechanism portion for transferring external force and the transferred mechanism portion provided closer to the rotational axis is released.

Such a difference in the rotational speed, i.e., a difference between the rotational speed of the stainless steel shaft when the stainless steel shaft is rotated from the lowermost portion to the uppermost portion in one direction by 180 degrees, and the rotational speed of the stainless steel shaft from the uppermost portion to the lowermost portion in one direction by 180 degrees, is generated when there is substantially no developer left in a development tank. When there is a sufficient amount of developer left in the development tank, the difference is not generated. In other words, when there is a sufficient amount of developer left in the development tank, so that the stainless steel shaft is buried in the developer, the load of the developer is applied to the stainless steel shaft. Therefore, even when the stainless steel shaft is slightly further rotated in one direction from the uppermost portion, so that the eccentric load of the stainless steel shaft is generated, a load which can cancel the eccentric load is applied from the developer to the stainless steel shaft. As a result, also during a time when the stainless steel shaft is rotated by 180 degrees in one direction from the uppermost portion to the lowermost portion, the transferring mechanism portion for transferring the external force is engaged with and pushes down in one direction the transferred mechanism portion provided closer to the rotational axis, so that the rotational force is transferred. In other words, when there is a sufficient amount of developer left in the development tank, the stainless steel shaft is consistently rotated with a predetermined rotational speed irrespective of the eccentric load of the stainless steel shaft.

As can be seen from the foregoing description, the stainless steel shaft has a rotational speed pattern corresponding to one cycle of rotation, which varies depending on the remaining amount of a developer in the development tank. Therefore, in the above-described structure, by using the rotation detector to detect the rotational speed pattern, the remaining amount of the developer may be detected. In this case, the rotation detector is provided in the stainless steel shaft. The first coil spring which is inserted around the stainless steel shaft has an ability to convey the developer in the development tank, for example, from both end portions to a middle portion thereof. Specifically, in the above-described structure, the first coil spring may be composed of two separate coil springs having different winding directions. In this case, the powder pressure of the developer in the development tank is made uniform and the surface of the developer is consistently made flat. Therefore, it is possible to maintain satisfactory image quality and detect the remaining amount of the developer with high precision without occurrence of a detection error which is a problem with conventional techniques. In addition, the spring shape can prevent the developer from being tightly attached in a pitch of the helix.

In an example embodiment, the stainless steel shaft may be disposed above the development supply roller. With such an arrangement, the powder pressure of the developer can be made uniform in the vicinity of the development supply roller and in the vicinity of the developer layer thickness limiting member (layer thickness limiting blade), resulting in a stable operation. The rotation detector may generate a plurality of output pulses per cycle of rotation of the stainless steel shaft, which is the auger conveyor member. Thereby, the remaining amount of the developer can be detected with higher precision.

As used in an example embodiment, when the first coil spring having a play is used for stirring and conveying, the first coil spring may be able to be moved in a radial direction (a radial direction perpendicular to a center axis of the stainless steel shaft). In this case, toner which is located around the helix and may cause compaction is removed by rotation without retention, thereby making it possible to prevent adverse effects, such as packing and compacting, resulting in a highly reliable development operation. In addition, when a load is applied due to the developer (e.g., toner) while rotation drive is performed, the absence of the stainless steel shaft would bend and deform the first coil spring to cause the first coil spring to contact with the inner wall of the housing, leading to a failure. According to the above-described structure, the deformation is limited by the stainless steel shaft, resulting in a highly reliable operation.

As described above, in the above-described structure, the first coil spring may be composed of two separate coil springs having different winding directions. For example, the first coil spring may be composed of two separate coil springs which are separated at a middle portion of the stainless steel shaft and have right-hand and left-hand winding directions. With the two separate coil springs having the opposite winding directions, the developer in the development tank is, for example, transferred from both ends to the middle portion as if the developer were collected together, so that the powder pressure of the developer in the development tank is made uniform and the surface of the developer is consistently made flat. Therefore, it is possible to maintain satisfactory image quality and detect the remaining amount of the developer with high precision without occurrence of a detection error which is a problem with conventional techniques. If the above-described screw is used to achieve a stirring function (a function to loosening agglomerated toner), a conveying force may be excessively strong so that a thickness of the developer is likely to become excessively high at the middle portion. In contrast, the first coil spring has a high degree of freedom for setting a stirring force and a conveying force, thereby making it possible to easily solve such a problem.

In the above-described structure, the first coil spring may be inserted around the stainless steel shaft, leaving a clearance which allows the first coil spring to be moved in a thrust direction (a direction along the center axis of the stainless steel shaft). By inserting the first coil spring around the stainless steel shaft, leaving such a clearance, even when the first coil spring is stretched and deformed due to the load of the developer or the like, the clearance can absorb the deformation, thereby making it possible to prevent a failure due to contact of the stretched coil spring with a side wall of the housing. In this case, both end portions of each of the separate coil spring may be tightly wound around the stainless steel shaft. By tightly winding, adjacent end portions of the plurality of separate coil springs can be prevented from accidentally entangling each other. In addition, the end portions of the separate coil springs can be prevented from scratching the inner wall of the housing when the coil spring is slid to rub the inner wall of the housing.

In the above-described structure, an outer end portion of the separate coil spring is formed projecting in an outward direction perpendicular to the center axis of the stainless steel shaft, the projected tip portion is inserted through a long hole formed in an engagement plate provided in the weight member, and the separate coil spring can be rotated by a predetermined angle limited by the long hole. When the separate coil spring can be freely rotated, the drag of the developer causes the separate coil spring to rotate, so that an operation of conveying the developer in a thrust direction becomes unstable. However, by limiting an angle of rotation, it is possible to achieve a stable operation of conveying the developer in the thrust direction without being affected by the drag of the developer.

In the above-described structure, the separate coil spring may contact with the inner wall surface of the development tank when the stainless steel shaft is rotated. Thus, the separate coil spring contacts with the inner wall surface and is therefore forcibly moved in a radial direction, resulting in an effect of further loosening compaction of the developer.

In the above-described structure, a second coil spring may be provided near an outer end portion of the separate coil spring, facing and paralleling to the separate coil spring, and the second coil spring may be moved in the thrust direction and in the radial direction. Specifically, in the above-described structure, the second coil spring may be inserted around a pair of holding projected portions provided on the inner wall surface of the development tank, in a manner which allows free play of both ends of the second coil spring. The second coil spring may also contact with the stainless steel shaft and/or the first coil spring when the stainless steel shaft is rotated. Further, in the above-described structure, the second coil spring may be wound in a direction opposite to a winding direction of the opposed separate coil spring. Thus, when the second coil spring is disposed near the outer end portion of the separate coil spring, an effect of further loosening compaction of developer can be obtained, making it possible to convey the developer more stably.

Note that, in the above-described structure, each of the coil springs may be formed to satisfy $D/2<P$, where a helical pitch thereof is represented by P (mm) and an outer diameter thereof is represented by D (mm). When such a relationship is satisfied, it is possible to improve the amount of conveyed developer and suppress a developer from being attached to the coil spring.

In order to achieve the above-described object, another (second) development apparatus of an example embodiment includes an auger conveyor member for stirring and conveying developer (e.g., toner), the gravity of the developer being eccentrically distributed with respect to a center of rotation, and a drive transfer member for driving and rotating the auger conveyor member. The auger conveyor member is provided near a development supply roller, and a uniforming member for making the developer uniform is provided in a space portion between the development supply roller and the auger conveyor member. The development apparatus may further include a rotation detector for detecting a rotational state of the auger conveyor member. The remaining amount of the developer may be detected based on the rotational state detected by the rotation detector.

The eccentric gravity distribution may be achieved by a rod-like weight member eccentrically disposed and fixed with respect to the rotational axis. The auger conveyor member may include a helical member having an inner diameter larger than an outer diameter of the weight member. The helical member may be rotatably inserted around the weight member. The helical member may be a coil spring.

According to the thus-constructed development apparatus, when the toner supplying roller is close to the auger conveyor member due to miniaturization of the apparatus, the uniforming member can prevent irregular image density, which would otherwise occur due to the helical pitch of the coil spring.

In the above-described structure, one end portion of the uniforming member may be fixed to and supported by the inner wall of the development tank upstream in a roller rotational direction of the development supply roller, and the other end portion of the uniforming member located downstream from the roller rotational direction may be a free end. Thus, the uniforming member is supported and fixed at only one end, so that the other end portion can be freely swung upward and downward, resulting in a more stable uniforming operation.

In the above-described structure, the other end portion of the uniforming member, which is a free end, may be located on a straight line between a center of roller rotation of the development supply roller and a center of drive rotation of the auger conveyor member, or downstream in the roller rotational direction from the straight line. In this case, the other end portion of the uniforming member may be slightly extended downstream in the roller rotational direction, thereby making it possible to achieve a more stable uniforming operation. Note that the uniforming member is preferably an elastic film. In this case, the projected amount of the other end portion toward the downstream is preferably about 2 mm. In the above-described structure, the uniforming member may be formed of an elastic film. In this case, the elastic film can be deformed, depending on the pressure of the developer, thereby making it possible to prevent melted developer from being attached due to an abnormal increase in the pressure of partial developer and the charge amount of the developer from being non-uniform. Specifically, the elastic film is preferably made of polyethylene terephthalate.

A surface of the uniforming member may have a releasing ability. Specifically, melted developer can be prevented from being attached to the surface of the uniforming member by, for example, coating the surface of the uniforming member with PTFE film or fluorocarbon resin coating, or alternatively, plating with nickel-PTFE composite.

As described above, in the second development apparatus of an example embodiment, a function and an effect of the uniforming member can be more effectively exhibited when the auger conveyor member is provided above the development supply roller. Specifically, when the auger conveyor member is provided above the development supply roller, an irregular image occurs more easily than when the toner supplying roller and the auger conveyor member are horizontally arranged side by side. Therefore, by applying the uniforming member to such a vertical arrangement, the function and effect of the uniforming member can be more significantly exhibited.

An effect of the second development apparatus of an example embodiment described above can be exhibited to a further extent when the development apparatus is not provided with a replenishing roller for controlling the replenished amount of developer in the development tank. When the developer is made of a single non-magnetic component, the effect of the second development apparatus is exhibited to a further extent. A two-component developer including a carrier can prevent blocking of the developer due to the carrier. Therefore, the function and effect of the uniforming member in the second development apparatus are more effectively exhibited when the development agent is made of a single non-magnetic component.

BRIEF DESCRIPTION OF THE DRAWINGS

FIG. 4(*a*) is a front view of a transfer rotating plate. FIG. 4(*b*) is a side view of the transfer rotating plate. FIG. 4(*c*) is a front view of a rotated plate. FIG. 4(*d*) is a side view of the rotated plate.

FIG. 5 is a diagram for explaining a sequence of how an auger conveyor roller is rotated by a drive transfer member.

FIG. 6(*a*) is a diagram illustrating a detection waveform when there is toner. FIG. 6(*b*) is a diagram illustrating a detection waveform when there is no toner.

FIG. 8(*a*) is a diagram illustrating a detection waveform when there is toner. FIG. 8(*b*) is a diagram illustrating a detection waveform when there is no toner.

FIG. 12(*b*) is a cross-sectional view, taken along line B-B in FIG. 11. FIG. 12(*c*) is a cross-sectional view, taken along line C-C in FIG. 11.

DESCRIPTION OF THE PREFERRED EMBODIMENTS

Hereinafter, an image forming apparatus including a development apparatus according to an example will be described with reference to the accompanying drawings.

Example Embodiment 1

Explanation of Whole Image Forming Apparatus

Figure 1:
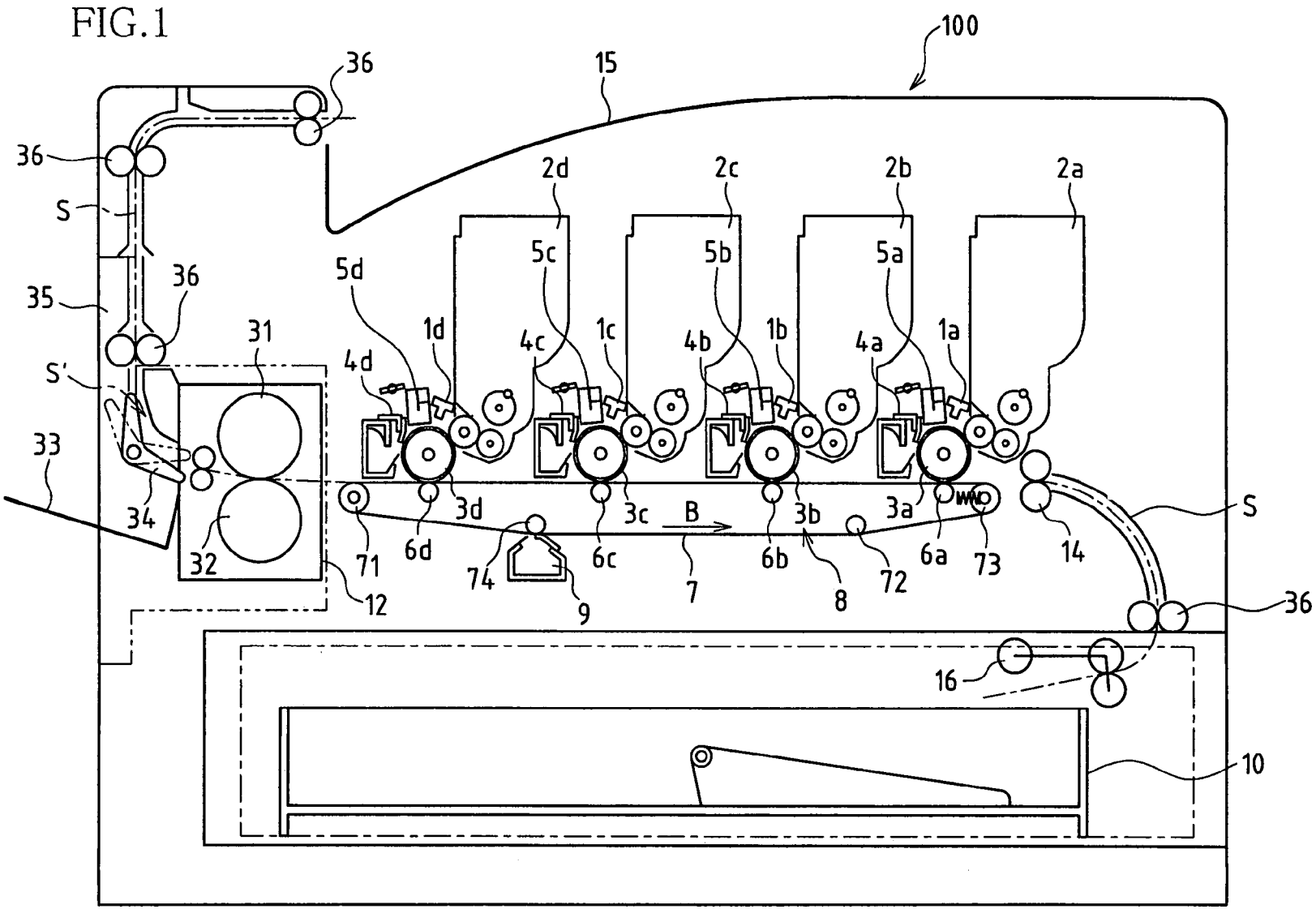
FIG. 1 is a cross-sectional view schematically illustrating a structure of a digital color photocopying machine as a color image forming apparatus on which the development apparatus of Example Embodiment 1 is mounted.

FIG. 1 is a cross-sectional view schematically illustrating a structure of a digital color photocopying machine (hereinafter simply referred to as a copier) 100 as a color image forming apparatus according to Example Embodiment 1

The copier 100 forms a multicolor or monocolor image on a predetermined sheet (recording paper) in accordance with externally input image data. The copier 100 is composed of an exposure unit 1, a development apparatus 2, a photoconductive drum 3, an electrifier 5, a cleaner unit 4, a transfer conveying belt unit 8, a fixing unit 12, a paper conveying path S, a paper feed tray 10, paper output trays 15 and 33, and the like.

The copier 100 processes image data corresponding to a color image having black (K), cyan (C), magenta (M), and yellow (Y) colors. Therefore, the exposure unit 1 (1*a*, 1*b*, 1*c*, 1*d*), the development apparatus 2 (2*a*, 2*b*, 2*c*, 2*d*), the photoconductive drum 3 (3*a*, 3*b*, 3*c*, 3*d*), the electrifier 5 (5*a*, 5*b*, 5*c*, 5*d*), and the cleaner unit 4 (4*a*, 4*b*, 4*c*, 4*d*) each include four units so as to produce four latent images corresponding to the respective colors. Note that the affix "a" indicates correspondence to black, "b" indicates correspondence to cyan, "c" indicates correspondence to magenta, and "d" indicates correspondence to yellow. Thus, there are four image stations.

The photoconductive drum 3 is disposed (attached) at substantially a center portion of the copier 100.

The electrifier 5 is charging means of charging a surface of the photoconductive drum 3 so that the surface uniformly has a predetermined potential. Examples of the charging means include roller or brush electrifiers of contact type, and the electrifier of charger type illustrated in FIG. 1.

The exposure unit 1 may be, for example, an EL or LED write head having an array of light emitting elements, or a laser scanning unit (LSU) having a laser irradiation section and a reflection mirror. The exposure unit 1 has a function to expose the charged photoconductive drum 3 to light in accordance with the input image data to form on its surface an electrostatic latent image corresponding to the image data.

The development apparatus 2 develops the electrostatic latent image formed on each photoconductive drum using a toner (herein called a developer) of a corresponding color (K, C, M, Y). The cleaner unit 4 removes and recovers a toner left on the surface of the photoconductive drum 3 after development and image transfer.

The transfer conveying belt unit 8, which is placed below the photoconductive drum 3, includes a transfer belt 7, a transfer belt-driven roller 71, a transfer belt tension roller 73, transfer belt following rollers 72 and 74, a transfer roller 6 (including transfer rollers 6*a*, 6*b*, 6*c*, 6*d* corresponding to the respective colors), and a transfer belt cleaning unit 9.

The transfer belt-driven roller 71, the transfer belt tension roller 73, the transfer roller 6, the transfer belt following rollers 72 and 74, and the like are used to support and stretch the transfer belt 7 tight and rotate the transfer belt 7 in a direction indicated by arrow B.

The transfer roller 6 is rotatably supported by a transfer roller attachment portion of a housing (not shown) of the transfer conveying belt unit 8. The transfer roller 6 is also used to provide transfer bias for transferring a toner image on the photoconductive drum 3 onto a sheet which is held by suction and conveyed on the transfer belt 7.

The transfer belt 7 is placed in contact with each drum (3*a*, 3*b*, 3*c*, 3*d*) of the photoconductive drum 3. The toner images of the colors formed on the photoconductive drum 3 are successively transferred onto a sheet to form a color toner image (multicolor toner image). The transfer belt is made of a film having a thickness of 100 μm to 150 μm and is an endless belt.

The toner image is transferred from the photoconductive drum 3 onto a sheet using the transfer roller 6, which is in contact with a bottom side of the transfer belt 7. A high-voltage transfer bias (a high voltage having a polarity (+) reverse to the polarity (−) of charge of the toner) for transferring the toner image is applied to the transfer roller 6. The transfer roller 6 is a roller which has a metal shaft (e.g., stainless steel) having a diameter of 8 to 10 mm as a base, whose surface is covered with a conductive elastic material (e.g., EPDM, urethane foam, etc.). By using the conductive elastic material, a high voltage can be uniformly applied to the sheet. In Example Embodiment 1, the transfer roller 6 is used as the transfer electrode. Alternatively, a brush or the like may be used.

The toner attached on the transfer belt 7 may cause a stain on a rear side of the sheet when the transfer belt 7 is in contact with the photoconductive drum 3. To avoid this, the toner is supposed to be removed or recovered using the transfer belt cleaning unit 9. The transfer belt cleaning unit 9 may be provided with, for example, a cleaning blade as a cleaning member which is in contact with the transfer belt 7. The transfer belt 7, which is in contact with the cleaning blade, is supported on the rear thereof by the transfer belt following roller 74.

The paper feed tray 10 is a tray which holds a sheet on which an image is to be formed, and is provided in a lower portion of an image forming portion of the copier 100. The paper output tray 15, which is provided in an upper portion of the copier 100, is a tray on which a printed sheet is placed facing down. The paper output tray 33, which is provided in a side portion of the copier 100, is a tray on which an image-printed sheet is placed facing up.

The copier 100 is also provided with the S-shaped paper conveying path S, through which a sheet on the paper feed tray 10 is transferred via the transfer conveying belt unit 8 and the fixing unit 12 to the paper output tray 15. In addition, a pickup roller 16, a resist roller 14, a fixing section 12, a conveying direction switch guide 34, a conveying roller 36 for conveying a sheet, and the like are provided in the vicinity of the paper conveying path S ranging from the paper feed tray 10 to the paper output tray 15 and the paper output tray 33.

The conveying roller 36 is a small-size roller for promoting and assisting conveying of a sheet, and includes a plurality of rollers which are provided along the paper conveying path S. The pickup roller 16 is a roller which is provided at an end portion of the paper feed tray 10 and feeds sheets from the paper feed tray 10 to the paper conveying path S on a sheet-by-sheet basis.

The conveying direction switch guide 34 is rotatably provided on a side cover 35. By changing a state of the conveying direction switch guide 34 from what is indicated with a solid line to what is indicated with a dashed line, a sheet is removed partway through the paper conveying path S, so that the sheet is output to the paper output tray 33. In the case of the state indicated with the solid line, a sheet is transferred through a conveying portion S' (a portion of the paper conveying path S) between the fixing unit 12, and the side cover 35 and the conveying direction switch guide 34, and is output to the upper paper output tray 15.

The resist roller 14 temporarily holds a sheet conveyed on the paper conveying path S. The resist roller 14 also has a function to transfer the sheet to the transfer belt 7 with appropriate timing with respect to rotation of the photoconductive drum 3 so that multiple toner images on the photoconductive drum 3 are satisfactorily transferred onto the sheet.

Specifically, the resist roller 14 transfers a sheet in a manner which causes a tip of the toner image on each drum (3*a*, 3*b*, 3*c*, 3*d*) of photoconductive drum 3 to coincide with a tip of an image-formed range of the sheet, based on a detected signal output by the detection switch (not shown).

The fixing unit 12 includes a heat roller 31, a pressure roller 32, and the like. The heat roller 31 and the pressure roller 32 are constructed to rotate while sandwiching a sheet.

The heat roller 31 is also controlled by a control section based on a signal from a temperature detector (not shown) so that the heat roller 31 has a predetermined fixing temperature. The heat roller 31 is used along with the pressure roller 33 to apply heat and pressure to a sheet so that a multicolor toner image transferred on the sheet is melt, mixed, and joined with pressure to be thermally fixed onto the sheet.

After fixing of the multicolor toner image, the sheet was conveyed by the conveying roller 36 to the reverse output path of the paper conveying path S, so that the reversed paper (the multicolor toner image facing down) is output onto the paper output tray 15.

Explanation of Development Apparatus of Example Embodiment 1

Figure 2:
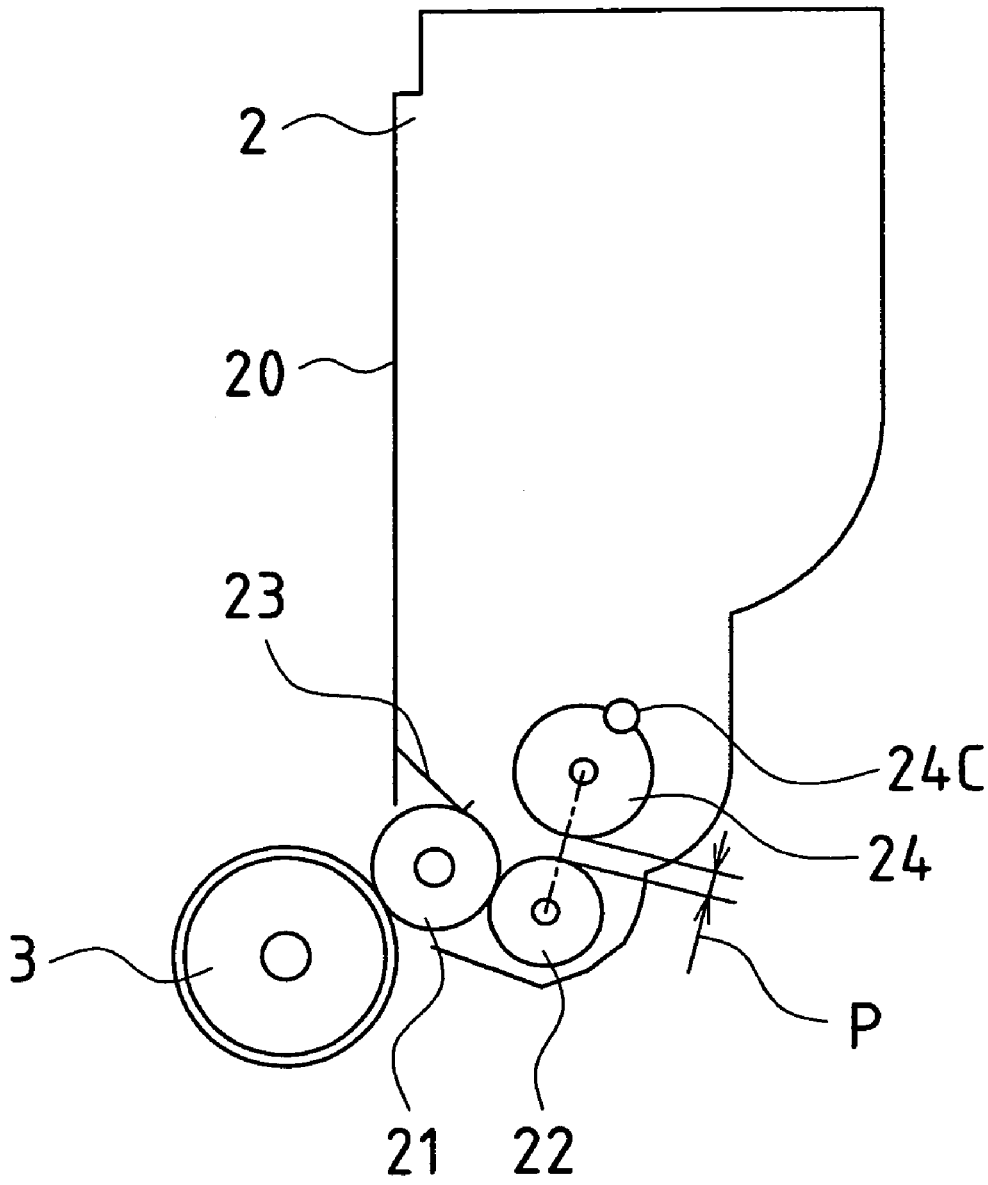
FIG. 2 is an enlarged cross-sectional view schematically illustrating the development apparatus of Example Embodiment 1.

FIG. 2 is an enlarged cross-sectional view schematically illustrating the development apparatus of Example Embodiment 1.

The development apparatus 2 includes a development tank 20, a development roller 21, and a toner supplying roller 22. In the development tank 20, the development roller 21 is disposed horizontally (perpendicular to the drawing plane) opposing the photoconductive drum 3, and the toner supplying roller 22 is horizontally disposed in contact with the development roller 21 . The development roller 21 is provided with a layer thickness limiting blade 23 for limiting a layer thickness of toner attached to the development roller 21. An auger conveyor roller 24 for stirring and conveying s-toner is horizontally provided above and near the toner supplying roller 22, and near the layer thickness limiting blade 23. In Example Embodiment 1, the gravity of the auger conveyor roller 24 is eccentrically distributed with respect to the center of rotation thereof.

Figure 3:
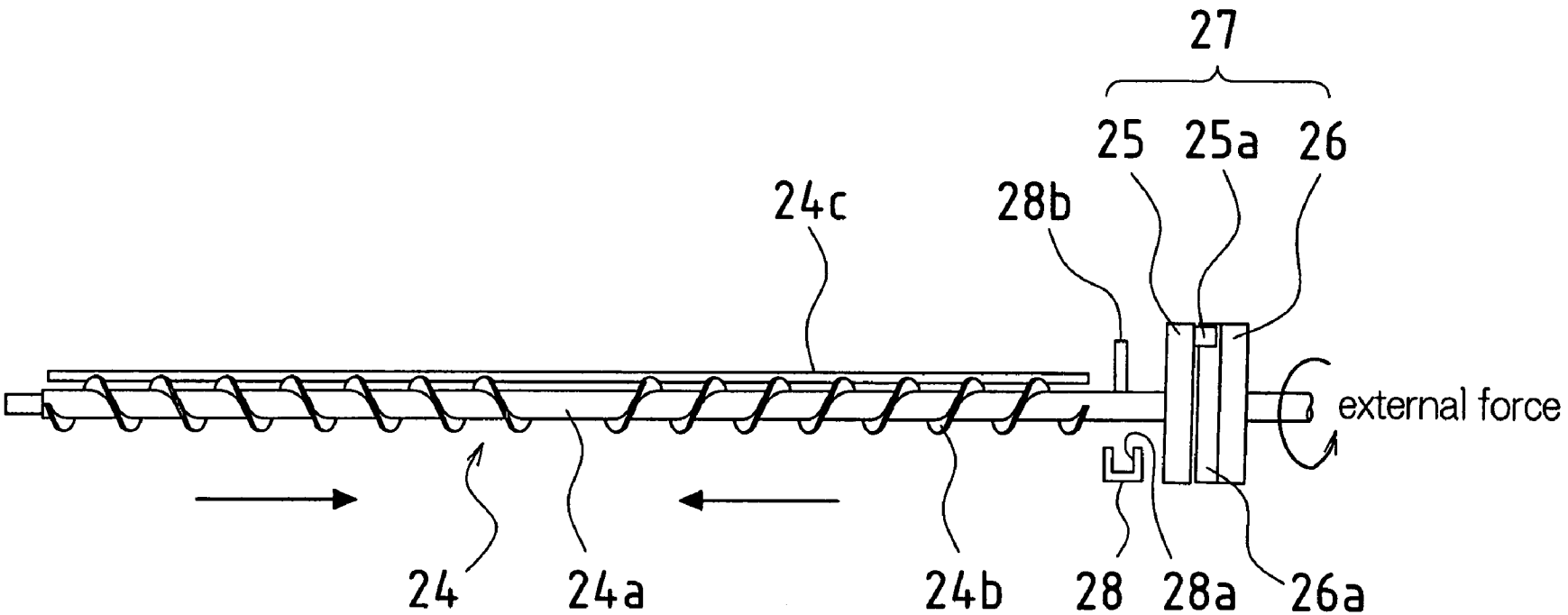
FIG. 3 is a diagram for explaining an exemplary developer detecting mechanism section of the development apparatus of Example Embodiment 1.
Figure 4A:
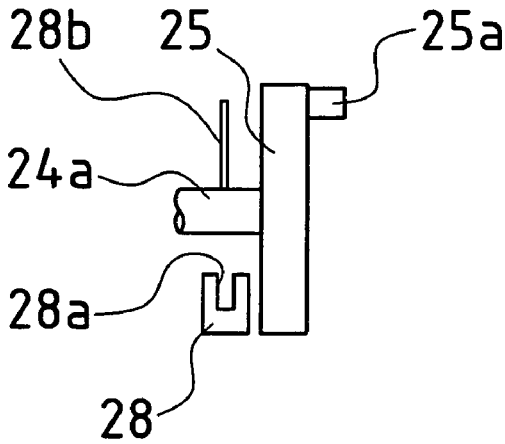
FIG. 4 is a diagram for explaining a structure of a transferring mechanism portion.
Figure 4C:
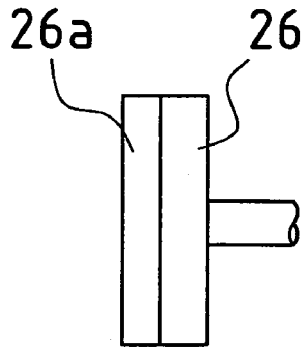
Figure 4B:
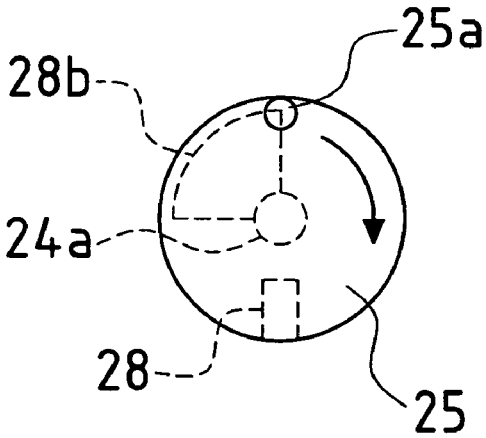
Figure 4D:
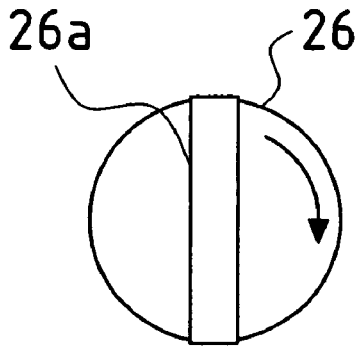

FIG. 3 is a diagram for explaining a developer detecting mechanism section of the development apparatus 2 of Example Embodiment 1.

The auger conveyor roller 24 includes a rotational axis 24*a*, and a conveying blade 24*b* which is arranged helically around the rotational axis 24*a*. A rod-like eccentric column 24*c* is attached to a peripheral end portion of the conveying blade 24*b* and is disposed in parallel with the rotational axis 24*a*. Specifically, the eccentric column 24*c* is fixed to a plurality of points of the peripheral end portion of the conveying blade 24*b* at constant intervals corresponding to a helical pitch of the conveying blade 24*b*. In Example Embodiment 1, the conveying blade 24*b* is divided into two, that is, a left portion and a right portion, which have opposite helical directions. Therefore, toner in the development tank 20 is conveyed from both ends to a middle portion thereof or from the middle portion to both the ends thereof, depending on the rotational direction of the rotational axis 24*a*. In Example Embodiment 1, it is assumed that the toner is conveyed from both the ends to the middle portion as indicated with an arrow in FIG. 3 .

A drive transfer member 27 is provided at an end portion of the rotational axis 24*a* (a right end portion in FIG. 3). The drive transfer member 27 has a clutch structure which can be engaged and disengaged and can transfer external force (rotational force) to the rotational axis 24*a* of the auger conveyor roller 24. The drive transfer member 27 includes a disk-like rotated plate 25 attached to the rotational axis 24*a*, and a disk-like transfer rotating plate 26 of transferring external force (not shown). The rotated plate 25 is provided with an engagement pin 25*a* at one point of a peripheral portion of a side thereof facing the transfer rotating plate 26 as illustrated in FIGS. 4(*a*) and 4(*b*). On the other hand, the transfer rotating plate 26 is provided with an engagement plate 26*a* which is provided on a side thereof facing the rotated plate 25 and projects diagonally through the center of rotation as illustrated in FIGS. 4(*c*) and 4(*d*).

FIG. 5 illustrates how the auger conveyor roller 24 is rotated by the drive transfer member 27 thus constructed. Note that, in this example, the engagement pin 25*a* and the eccentric column 24*c* are diagonally opposed to each other via the center of rotation of the rotated plate 25.

When the eccentric column 24*c* is rotated from a lowermost position illustrated in FIG. 5(*a*) via a position illustrated in FIG. 5(*b*) until an uppermost position illustrated in FIG. 5(*c*), i.e., rotated in one direction (clockwise) by 180 degrees, the engagement plate 26*a* of the transfer rotating plate 26, which transfers external force, is consistently engaged with the engagement pin 25*a* of the rotated plate 25 so that the engagement plate 26*a* pushes down the engagement pin 25*a* in one direction (clockwise).

Thereafter, assuming that there is no toner in the development tank 20, when the eccentric column 24*c* is slightly rotated from the uppermost position in one direction (clockwise), the auger conveyor roller 24 is rotated while increasing the rotational speed due to the eccentric load of the eccentric column 24*c*, as illustrated in FIG. 5(*d*). In other words, when the eccentric column 24*c* is rotated in one direction (clockwise) from the uppermost portion to the lowermost portion, the rotational speed of the auger conveyor roller 24 rotated by the eccentric load of the eccentric column 24*c* is higher than the rotational speed caused by the external force. As a result, the engagement pin 25*a* is freely rotated while being separated from the engagement plate 26*a* (i.e., in a disengaged state) as illustrated in FIGS. 5(*d*) and 5(*e*). In other words, when there is no toner in the development tank 20 (the remaining amount is small), one cycle of rotation of the auger conveyor roller 24 includes a period of time during which the rotational speed is high and a period of time during which the rotational speed is low.

On the other hand, assuming there is toner in the development tank 20 (i.e., the auger conveyor roller 24 is buried in the toner), when the eccentric column 24*c* is slightly further rotated from the uppermost portion in one direction (clockwise), so that the eccentric load of the eccentric column 24*c* is applied to the auger conveyor roller 24 , the toner applies a load which can cancel the eccentric load to the eccentric column 24*c*. As a result, the engagement plate 26*a* is rotated while being engaged with the engagement pin 25*a* and pushing the engagement pin 25*a* in one direction (clockwise) during a time when the eccentric column 24*c* is rotated by 180 degrees from the uppermost portion to the lowermost portion in one direction (clockwise), as illustrated in FIGS. 5 (*d*') and 5 (*e*'). In other words, when there is a sufficient amount of toner remaining in the development tank 20 , the auger conveyor roller 24 is consistently rotated with a constant rotational speed by external rotational force irrespective of the load of the eccentric column 24*c*.

As can be seen from the foregoing description, the auger conveyor roller 24 has a rotational speed pattern during one cycle of rotation, which varies depending on the remaining amount of the toner in the development tank 20. Therefore, by detecting the rotational speed pattern, the remaining amount of the toner can be detected.

Therefore, as illustrated in FIG. 3, a rotation detector 28 for detecting rotation of the auger conveyor roller 24 is provided between the auger conveyor roller 24 and the drive transfer member 27. The rotation detector 28 is a transmission-type photocoupler including a housing whose cross section is in a concave shape (a concave groove portion 28*a*), a light emitting element, and a light receiving element. In the housing, the light emitting element and the light receiving element are disposed facing each other over the concave groove portion 28*a*. The rotation detector 28 is oriented so that an opening of the concave groove portion 28*a* faces a center axis of the rotational axis 24*a*. On the other hand, the rotational axis 24*a*, which faces the opening of the concave groove portion 28*a*, is provided with a sector-shaped detection plate 28*b* as indicated with a dashed line in FIG. 4(*b*). The rotation of the auger conveyor roller 24 is detected by the detection plate 28*b* passing through the concave groove portion 28*a* of the rotation detector 28.

As described above, the rotational speed pattern of the auger conveyor roller 24 varies between when there is toner in the development tank 20 and when there is no toner in the development tank 20.

Figure 6A:
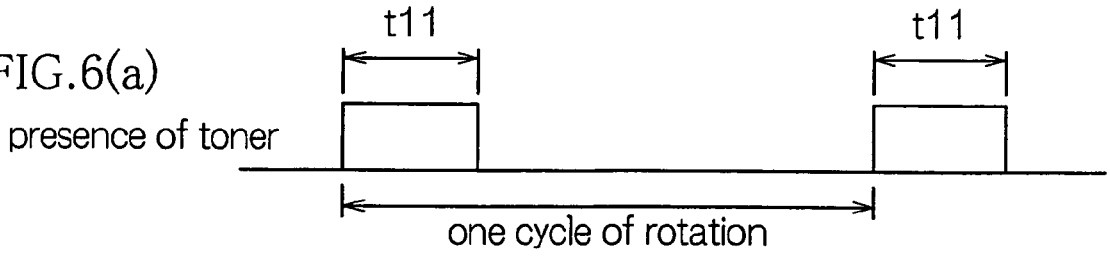
FIG. 6 is a diagram illustrating a detection waveform when a rotation detector detects rotation of an auger conveyor roller.
Figure 6B:
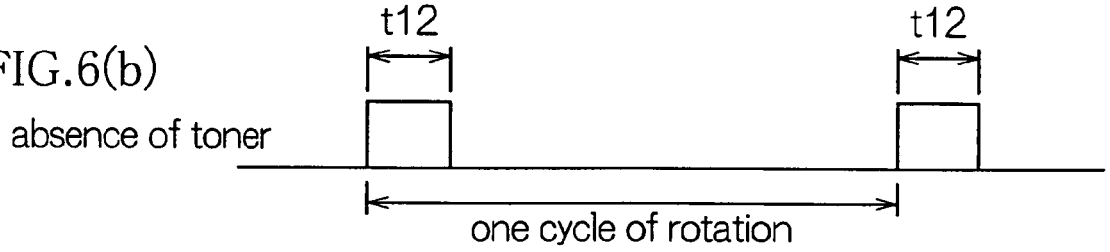

FIG. 6 is a diagram illustrating a detection waveform when the rotation detector 28 thus constructed detects the rotation of the auger conveyor roller 24. FIG. 6(*a*) is a diagram illustrating a detection wave when there is toner, and FIG. 6(*b*) is a diagram illustrating a detection wave when there is no toner. Note that it is assumed that the signal waveform has an "H" level when the detection plate 28*b* is passing through the concave groove portion 28 a of the rotation detector 28, i.e., the rotation detector 28 is in an OFF state. As illustrated in FIG. 6, a period of time of the "H" level varies between when there is toner and when there is no toner (t11>t12). Therefore, based on a difference between the time periods of the "H" level, it is possible to detect whether or not there is toner in the development tank 20. Specifically, when there is such a sufficient toner that the auger conveyor roller 24 is buried in the toner, the signal of FIG. 6(*a*) is detected. When the remaining amount of the toner is decreased, so that the auger conveyor roller 24 is exposed above a top surface of the toner, the signal of FIG. 6(*b*) is detected. Since the detection plate 28*b* of the rotation detector 28 is formed in the shape of a sector, the rotation detector 28 only detects one pulse signal per cycle of rotation of the auger conveyor roller 24. Therefore, basically, it is only detected whether or not there is a remaining toner. Note that the remaining amount of the toner can be detected by measuring a change in the time period of the "H" level, though the precision is low.

Figure 7:
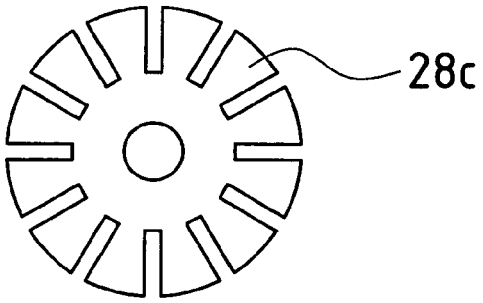
FIG. 7 is a diagram for explaining another example of a detection plate.

FIG. 7 illustrates another exemplary detection plate 28*c*. In this example, the detection plate 28*c* is formed in the shape of a disk, and a plurality of radial slit portions are equally spaced along the entire circumference of the disk. With the detection plate 28*c* having such a shape, the rotation detector 28 can detect a plurality of pulses per cycle of rotation of the auger conveyor roller 24.

Figure 8:
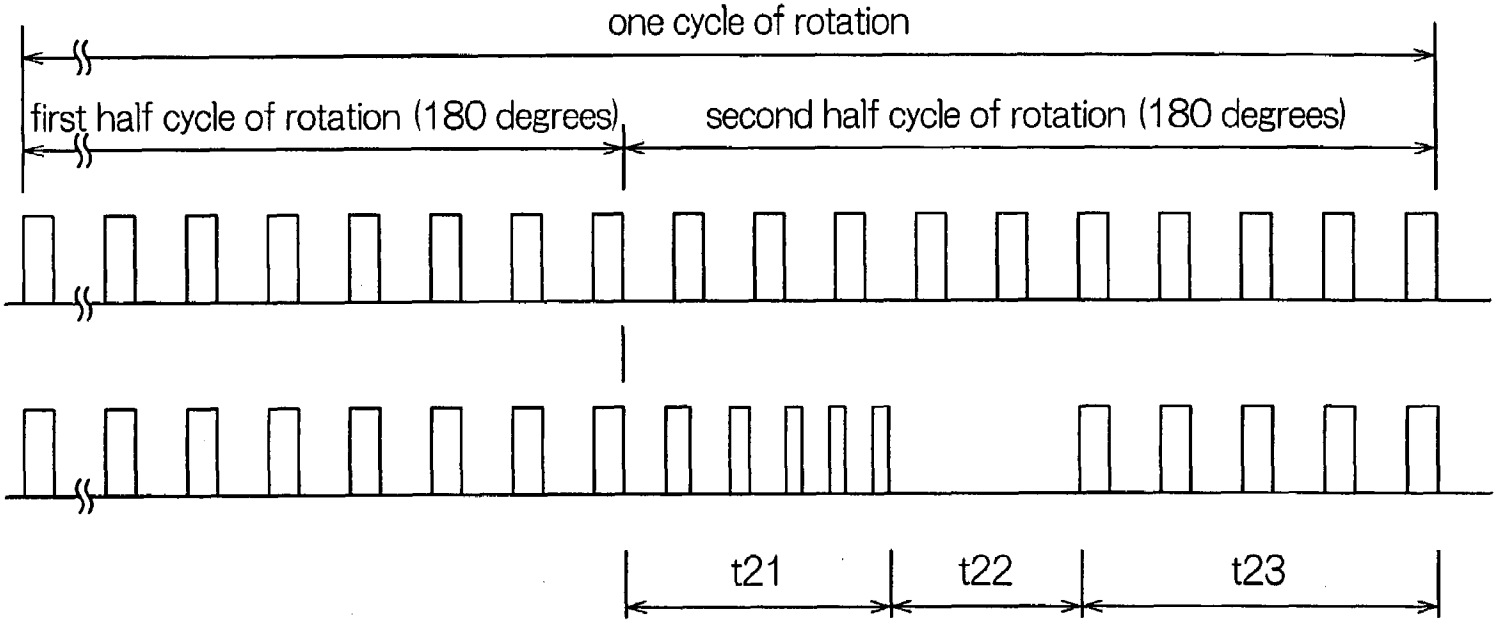
FIG. 8 is a diagram illustrating a detection waveform when a rotation detector detects rotation of an auger conveyor roller.

FIG. 8 is a diagram illustrating a detection pulse signal waveform of the rotation detector 28 of FIG. 7. FIG. 8(*a*) is a diagram illustrating a detection waveform when there is toner, and FIG. 8(*b*) is a diagram illustrating a detection waveform when there is no toner. Note that it is assumed that the signal waveform has an "H" level when the detection plate 28*c* is passing through the concave groove portion 28*a* of the rotation detector 28, i.e., the rotation detector 28 is in an OFF state.

When there is toner, the auger conveyor roller 24 is rotated with a constant speed during one cycle of rotation as described above. As a result, when there is toner, a detection pulse is detected at constant intervals as illustrated in FIG. 8(*a*).

In contrast, when there is no toner, the auger conveyor roller 24 is rotated with a constant speed during the first half (180 degrees) of one cycle of rotation, and is rotated with an increasing rotational speed during the next half (180 degrees) of the rotation cycle due to the eccentric load of the eccentric column 24*c*, as described above. As a result, the pulse width and pulse interval of a detection pulse are decreasingly short in the next half cycle of rotation as compared to those in the first half cycle of rotation, as illustrated in FIG. 8(*b*). In this example, a detection pulse disappears after about a midpoint of the next half cycle of rotation. This is a detection pulse waveform when the top surface of the toner in the development tank 20 exactly corresponds to a level of the center axis of the rotational axis 24*a* of the auger conveyor roller 24 . Specifically, as illustrated in FIG. 5(*d*), when the eccentric column 24*c* is slightly rotated from the uppermost portion in one direction (clockwise), the auger conveyor roller 24 is rotated with an increasing rotational speed due to the eccentric load of the eccentric column 24*c*. As a result, the pulse width and pulse interval of a detection pulse are decreasingly short as indicated in a time period t21 of FIG. 8(*b*). Thereafter, when the eccentric column 24*c* is rotated from the uppermost portion in one direction (clockwise) by about 90 degrees, the eccentric column 24*c* reaches the top surface of the toner, and the eccentric column 24*c* is caught by the toner, so that the rotation of the auger conveyor roller 24 is stopped. Therefore, the rotation of the auger conveyor roller 24 is stopped until the engagement plate 26 a of the transfer rotating plate 26 of the drive transfer member 27 catches up with the engagement pin 25*a* of the rotated plate 25 (a time period t22 in FIG. 8(*b*)), and during this time period, a detection pulse is not output. Note that, during the time period t22, the detection pulse may have the "H" level, depending on a position where the detection plate 28*c* is stopped. Thereafter, when the transfer rotating plate 26 is rotated by 90 degrees, so that the engagement plate 26*a* catches up with the engagement pin 25*a*, the engagement pin 25*a* is pushed again by the engagement plate 26*a*. Therefore, during the next time period t23, the rotation detector 28 outputs a detection pulse having the same pulse width and pulse interval as those during the first half cycle.

Thus, when there is no toner (exactly speaking, the remaining amount of the toner is reduced, so that the auger conveyor roller 24, which was buried in the toner, starts being exposed), the waveform (waveform pattern) of a detection pulse during the next half cycle of rotation differs from the waveform (waveform pattern) of a detection pulse during the first half cycle of rotation. The ratio of the three time periods t21, t22, and t 23 of the waveform (waveform pattern) varies, depending on the level of the top surface of atoner with respect to the auger conveyor roller 24. Therefore, by determining the ratio of these time periods, the toner remaining amount can be more precisely detected.

For example, when the sum of the time periods t21 and t22 is substantially equal to the time period t23, the top surface of the toner in the development tank 20 is positioned exactly at a height of the center axis of the rotational axis 24*a* of the auger conveyor roller 24. When the sum of the time periods t21 and t22 is significantly smaller than the time period t23, the top surface of the toner in the development tank 20 is positioned at a height such that a top portion of the auger conveyor roller 24 horizontally disposed is slightly exposed. When the sum of the time periods t21 and t22 is significantly larger than the time period t23, the top surface of the toner in the development tank 20 is positioned at a height such that the auger conveyor roller 24 horizontally disposed is completely exposed up to the vicinity of a lower portion thereof.

In Example Embodiment 1, the detection plate 28*b* or 28*c*, which is detected by the rotation detector 28, is attached to the rotational axis 24*a* of the auger conveyor roller 24. In addition, the auger conveyor roller 24 has a function to convey toner from both the ends to the middle portion of the development tanik 20 , and therefore, the powder pressure of the toner is made uniform and the toner is consistently made flat in the development tank 20. Therefore, it is possible to maintain satisfactory image quality and detect a remaining toner amount with high precision without occurrence of a detection error which is a problem with conventional techniques. In Example Embodiment 1, the auger conveyor roller 24 is disposed in the vicinity of a top portion of the toner supplying roller 22. By disposing the auger conveyor roller 24 at such a portion, the powder pressure of the toner can be made uniform in the vicinity of the toner supplying roller 22 and the layer thickness limiting blade 23, resulting in a more stable operation.

Example Embodiment 2

Next, a development apparatus which has a form different from that of Example Embodiment 1 will be described with reference to the accompanying drawings. Note that the development apparatus of Example Embodiment 2 has the same structure as that of Example Embodiment 1, except for the development apparatus 2 and the developer detecting mechanism section of Example Embodiment 1. Therefore, in Example Embodiment 2 the same parts as those of the developer detecting mechanism section of Example Embodiment 1 are indicated with the same reference numerals and will not be explained. A function and an effect different from those of Example Embodiment 1 will be described, and the same function, effect, and variation will not be explained.

Figure 9:
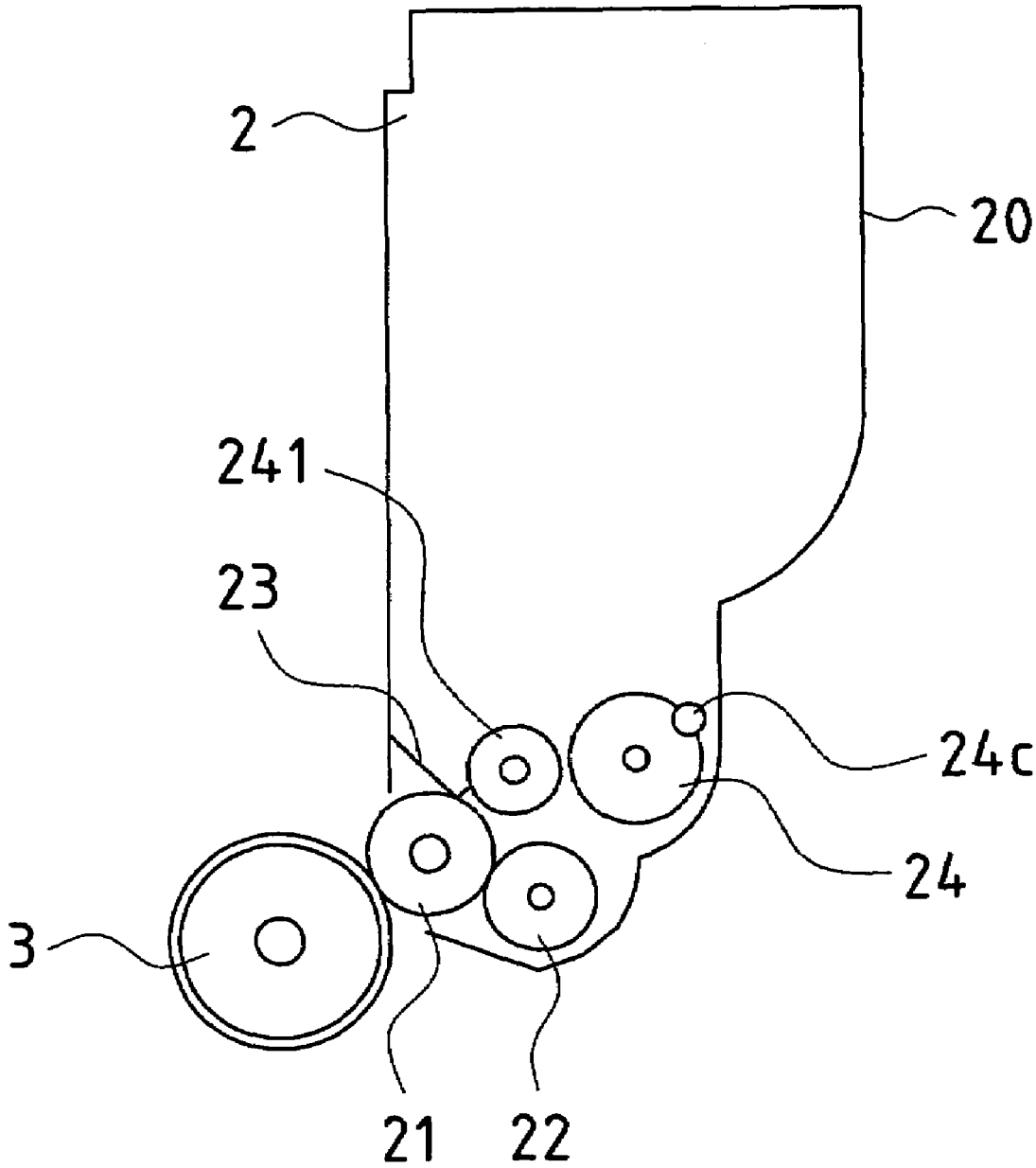
FIG. 9 is an enlarged cross-sectional view schematically illustrating a development apparatus according to Example Embodiment 2
Figure 10:
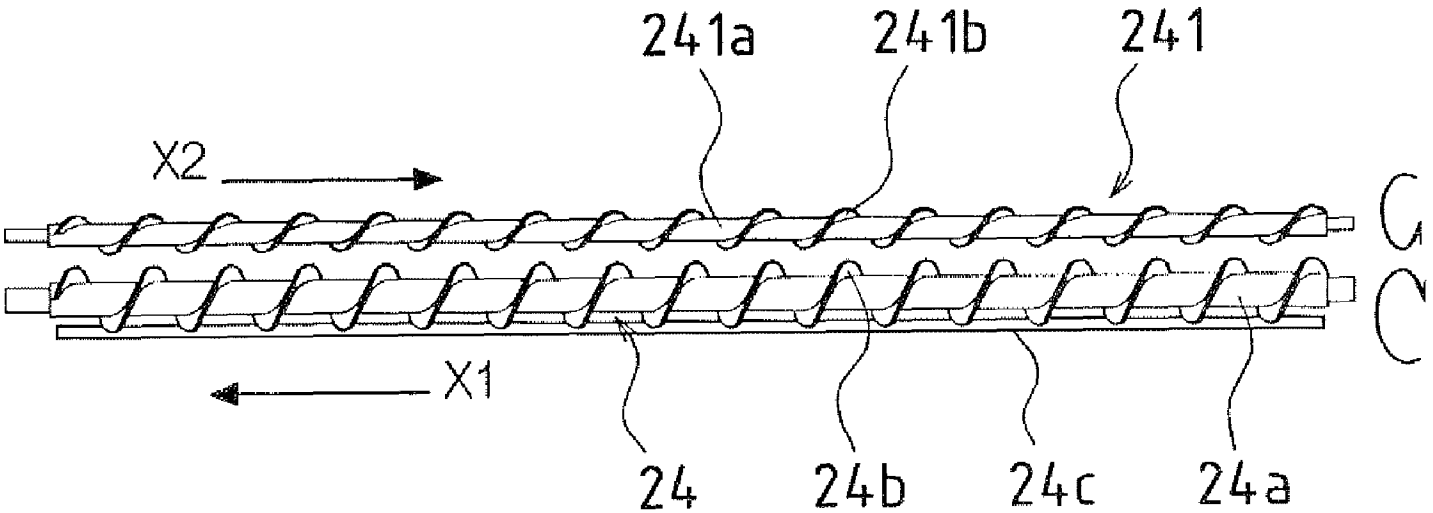
FIG. 10 is a diagram for explaining a developer detecting mechanism section of the development apparatus of Example Embodiment 2.

FIGS. 9 and 10 are diagrams for explaining a structure of a developer detecting mechanism section of a development apparatus 2 according to Example Embodiment 2.

The developer detecting mechanism section has the above-described auger conveyor roller 24 , and in addition, a single second auger conveyor roller 241 which is disposed near and in parallel with the auger conveyor roller 24. The gravity of the second auger conveyor roller 241 is not eccentrically distributed with respect to the center of rotation. Also in Example Embodiment 2, the conveying blade 24*b* of the auger conveyor roller 24 is not divided into two at the middle portion, and is helically turned in one direction throughout the entire longitudinal length. Similarly, a conveying blade 241*b* of the second auger conveyor roller 241 is helically turned in one direction throughout the entire longitudinal length. In addition, in Example Embodiment 2, the auger conveyor roller 24 and the second auger conveyor roller 241 are rotated in opposite directions. The auger conveyor roller 24 conveys the toner in the development tank 20 in a direction indicated with arrow Xl (from right to left in FIG. 10 ), while the second auger conveyor roller 241 conveys the toner in the development tank 20 in a direction indicated with arrow X2 (from left to right in FIG. 10 ). In other words, the toner conveying direction of the auger conveyor roller 24 is opposite to the toner conveying direction of the second auger conveyor roller 241. Thereby, the powder pressure of the toner can be made more uniform, and the top surface of the toner can be made flatter. As a result, it is possible to further improve image quality and remaining amount detection precision. Although the single second auger conveyor roller 241 is provided in Example Embodiment 2, two or more of the second auger conveyor rollers 241 may be provided.

Example Embodiment 3

Next, a development apparatus which has a form different from that of Example Embodiment 1 will be described with reference to the accompanying drawings. Note that the development apparatus of Example Embodiment 3 has the same structure as that of Example Embodiment 1, except for the development apparatus 2 and the developer detecting mechanism section of Example Embodiment 1. Therefore, in Example Embodiment 3, the same parts as those of the developer detecting mechanism section of Example Embodiment 1 are indicated with the same reference numerals and will not be explained. A fUnction and an effect different from those of Example Embodiment 1 will be described, and the same function, effect, and variation will not be explained.

Figure 11:
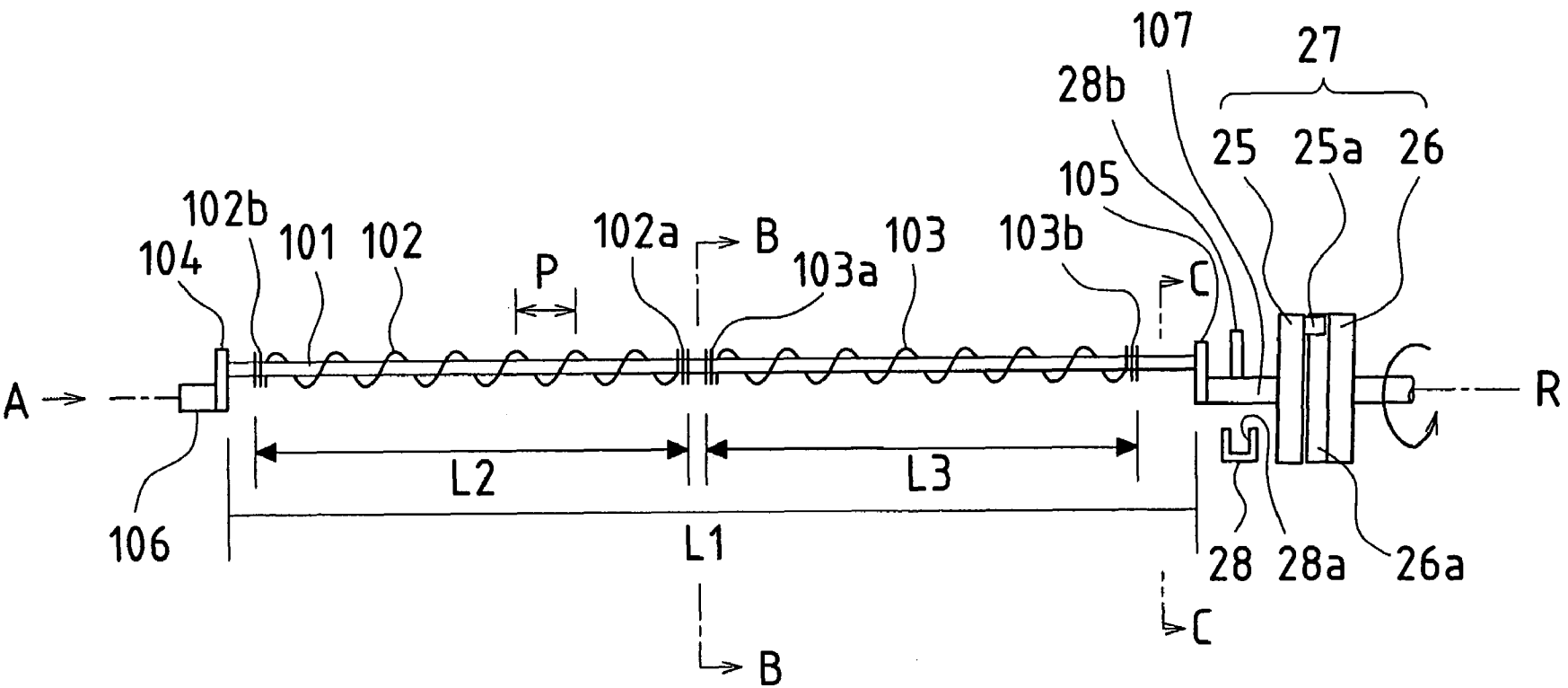
FIG. 11 is a diagram for explaining a developer detecting mechanism section of a development apparatus according to Example Embodiment 3
Figure 12:
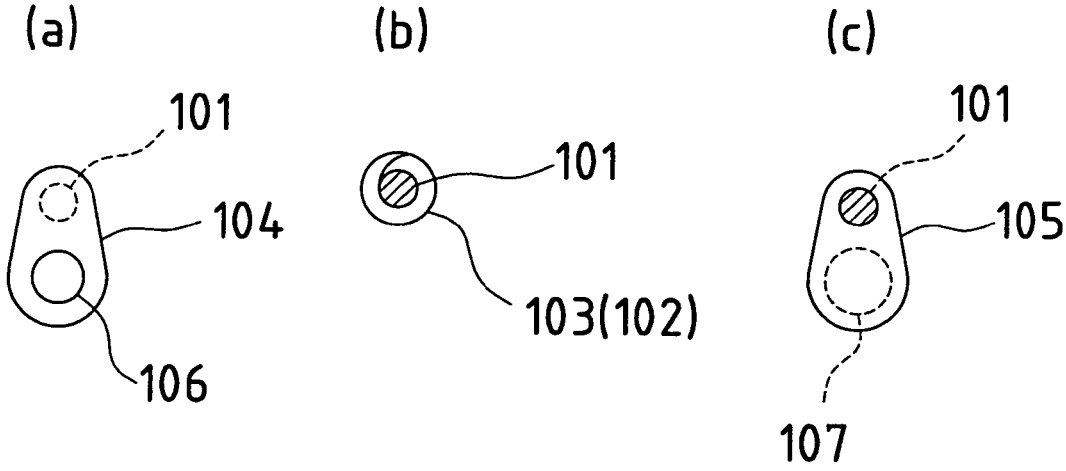
FIG. 12(*a*) is a diagram illustrating the developer detecting mechanism section of FIG. 11 when viewed from a direction indicated by arrow A.

FIGS. 11 and 12 are diagrams for explaining a structure of a developer detecting mechanism section of the development apparatus 2 according to Example Embodiment 3

The developer detecting mechanism section is in the shape of a crank, in which a stainless steel shaft 101 (outer diameter: 4 mm, herein also referred to as a rod-like weight member) is fixed to rotation support members 104 and 105 and is deviated by 6 mm from a center of drive rotation R. In FIGS. 11 and 12, reference numeral 106 indicates a rotational axis of the rotation support member 104 and reference numeral 107 indicates a rotational axis of the rotation support member 105.

Two coil springs 102 and 103 each having a wire diameter of 0.8 mm, an outer diameter of 8 mm, and a helical pitch (P) of 8 mm are inserted around the stainless steel shaft 101. The coil spring 102 is right-hand wound, while the coil spring 103 is left-hand wound.

An effective length of the stainless steel shaft 101 is represented by L1, a spring length of the coil spring 102 is represented by L2, and a spring length of the coil spring 103 is represented by L3. In this case, end portions of the coil springs 102 and 103 have a total of clearances of about 5 mm [≅L1−(L2+L3)], so that the coil springs 102 and 103 are independently moved freely in a radial direction and in a thrust direction.

Thus, since the coil springs 102 and 103 can be moved in the radial direction, a toner which is present around the helix and may cause compaction is removed by rotation without retention. Therefore, adverse effects, such as packing and compaction, can be prevented, thereby making it possible to achieve a highly reliable development operation. If the stainless steel shaft 101 is not provided, the coil springs 102 and 103 are bent and deformed due to load of a toner in association with rotation drive, so that the coil springs 102 and 103 may contact with an inner wall of a housing (not shown), leading to a failure. In contrast, with the above-described structure, the stainless steel shaft 101 limits the deformation, thereby making it possible to achieve a highly reliable operation. In addition, since the coil springs 102 and 103 are wounded in opposite directions, a toner in the development tank 20 (herein also referred to as a developer) is, for example, transferred from both ends to a middle portion thereof as if the toner were collected together, so that the powder pressure of the toner (developer) in the development tank 20 is made uniform and the toner is consistently made flat. Therefore, it is possible to maintain satisfactory image quality and detect the remaining amount of a toner (herein called a developer) with high precision without occurrence of a detection error which is a problem with conventional techniques.

Further, a spring wire member is tightly wound around both ends 102*a* and 102*b* of the coil spring 102 and both ends 103*a* and 103*b* of the coil spring 103, while providing a predetermined clearance with respect to the stainless steel shaft 101. By tightly winding in such a manner, the end portions 102*a* and 103*a* of the coil springs 102 and 103 are prevented from accidentally entangling each other at the middle portion. In addition, the other ends 102*b* and 103*b* of the coil springs 102 and 103 are prevented from scratching the inner wall of the housing (not shown) when the other ends 102*b* and 103*b* of the coil springs 102 and 103 are slid to rub the inner wall of the housing.

Example Embodiment 4

Next, a development apparatus which has a form different from that of Example Embodiment 3 will be described with reference to the accompanying drawings. Note that, in Example Embodiment 4, the same parts as those of the development apparatus 2 of Example Embodiment 3 are indicated with the same reference numerals and will not be explained. A function and an effect different from those of Example Embodiment 3 will be described, and the same function, effect, and variation will not be explained.

Explanation of Development apparatus of Example Embodiment 4

Figure 13:
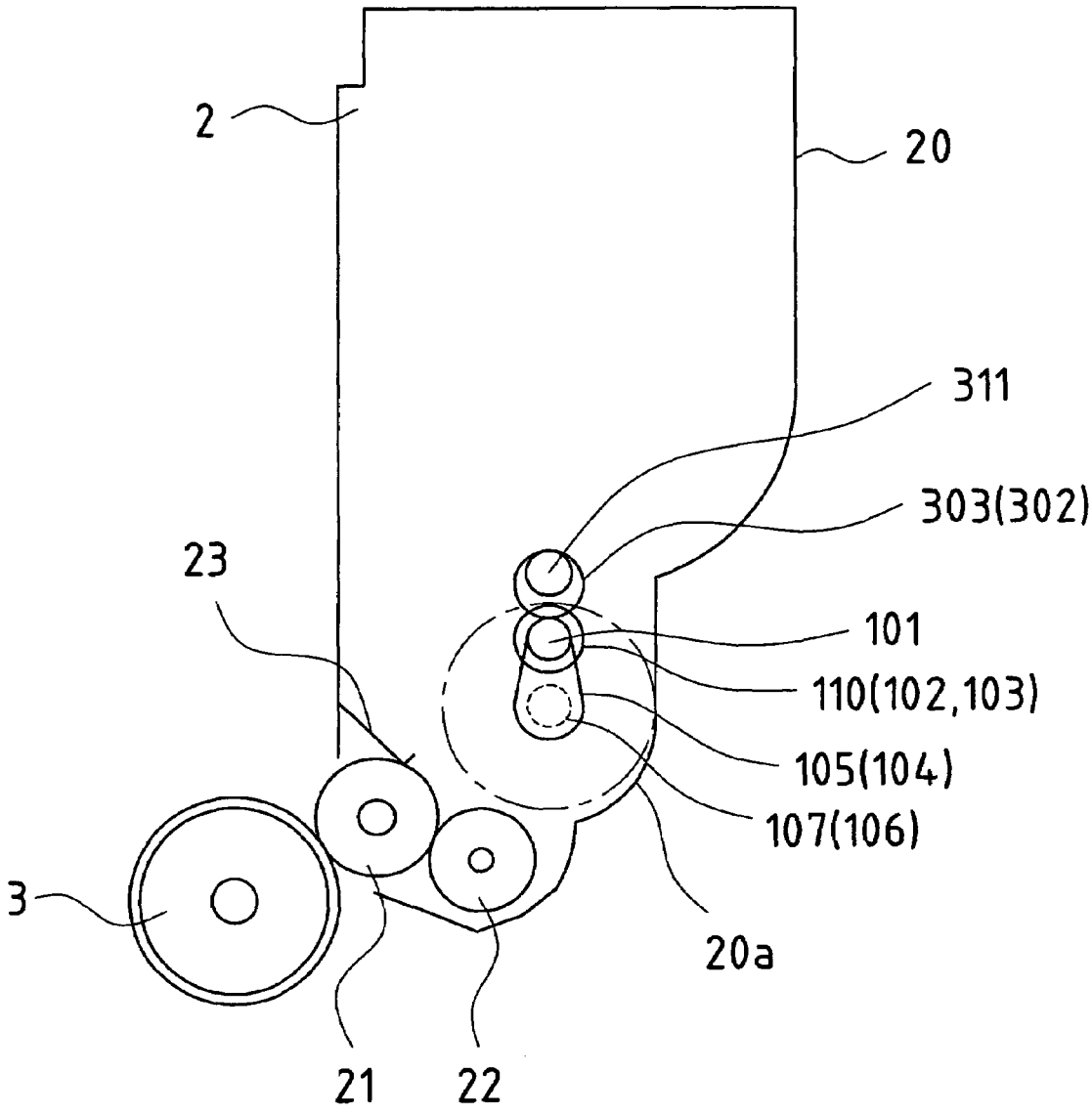
FIG. 13 is an enlarged cross-sectional view schematically illustrating a development apparatus according to Example Embodiment 4

FIG. 13 is an enlarged cross-sectional view schematically illustrating the development apparatus 2 of Example Embodiment 4 .

The development apparatus 2 includes a development tank 20, a development roller 21, and a toner supplying roller 22. In the development tank 20, the development roller 21 is disposed horizontally (perpendicular to the drawing plane) opposing the photoconductive drum 3, and the toner supplying roller 22 is horizontally disposed in contact with the development roller 21. The development roller 21 is provided with a layer thickness limiting blade 23 for limiting a layer thickness of a toner attached to the development roller 21. A stainless steel shaft 101 (weight member) for stirring and conveying a toner is horizontally provided above and near the toner supplying roller 22, and near the layer thickness limiting blade 23. A first coil spring 110 is inserted around the stainless steel shaft 101 in a manner which allows the first coil spring 110 to be rotated and limits an angle of the rotation to a predetermined angle.

Figure 14:
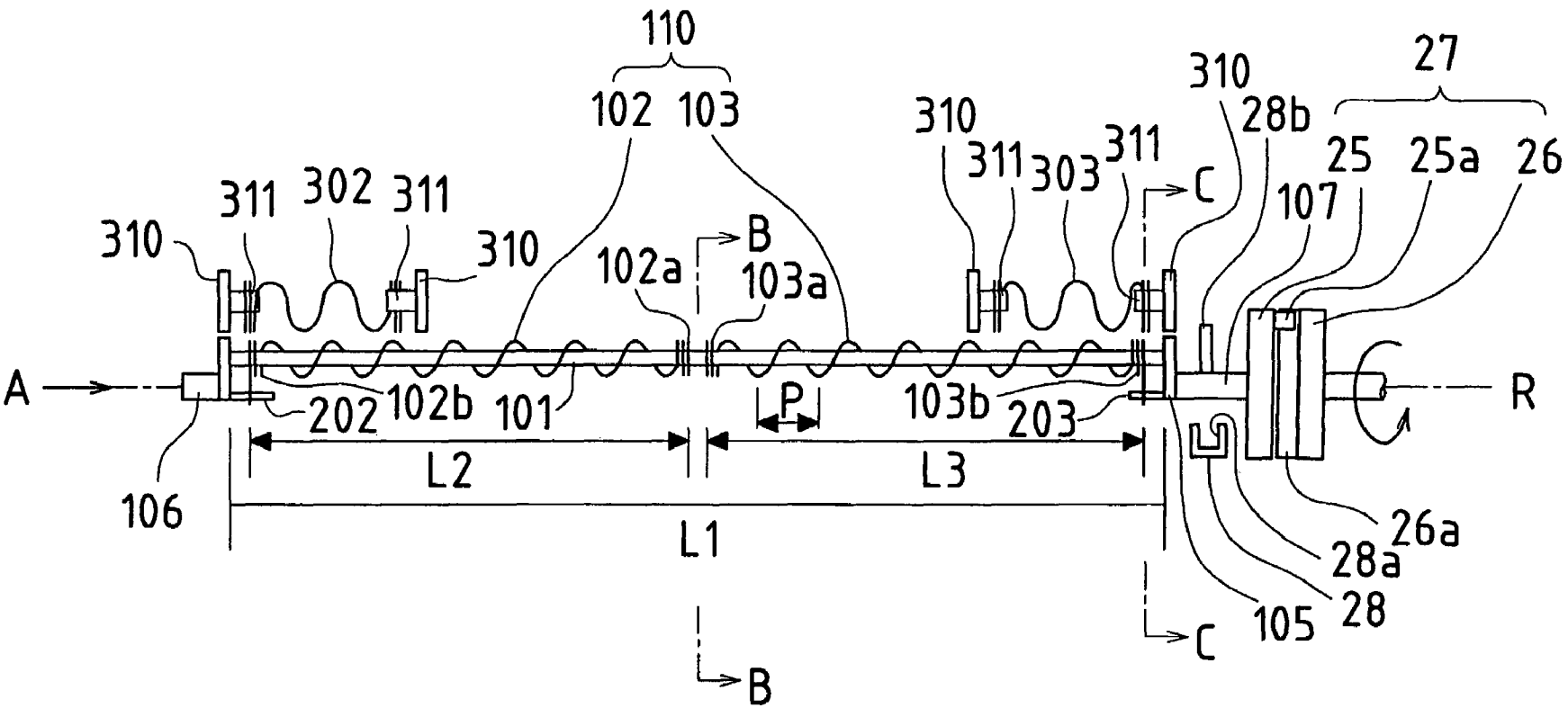
FIG. 14 is a diagram for explaining an exemplary developer detecting mechanism section of the development apparatus of Example Embodiment 4.

FIG. 14 is a diagram for explaining a developer detecting mechanism section of the development apparatus 2 of Example Embodiment 4.

The gravity of the stainless steel shaft 101 is eccentrically distributed with respect to a center of rotation. Specifically, the stainless steel shaft 101 is fixed to and supported by rotation support members 104 and 105 at both ends at positions deviated from centers of rotation R of rotational axes 106 and 107, respectively, resulting in a crank shape as a whole.

The first coil spring 110 has an inner diameter which is larger than an outer diameter of the stainless steel shaft 101. Therefore, the first coil spring 110 can be moved in a radial direction with respect to the stainless steel shaft 101 by a difference between the outer diameter of the stainless steel shaft 101 and the inner diameter of the first coil spring 110.

The first coil spring 110 is composed of two separate coil springs 102 and 103 having different winding directions (corresponding to the coil springs 102 and 103 of Example Embodiment 3). Specifically, the right-hand wound coil spring 102 and the left-hand wound coil spring 103 are separated from each other via a middle portion of the stainless steel shaft 101. By using the two separate coil springs 102 and 103 having the opposite winding directions, toner in the development tank 20 is, for example, transferred from both ends to the middle portion as if the toner were collected together, so that the powder pressure of the toner in the development tank 20 is made uniform and the toner is consistently made flat.

Further, the separate coil springs 102 and 103 are inserted around the stainless steel shaft 101 while leaving a clearance which allows the coil spring to be moved in a thrust direction. By inserting the coil springs 102 and 103 around the stainless steel shaft 101 while leaving a clearance, even when the coil springs 102 and 103 are expanded and deformed due to the load of a toner and the like, the clearance can absorb the deformation. In this case, a spring wire material is tightly wound with a small pitch at both end portions 102*a* and 102*b* of the coil spring 102 and both end portions 103*a* and 103*b* of the coil spring 103. By tightly winding in such a manner, the end portions 102*a* and 103*a* of the coil springs 102 and 103 are prevented from accidentally entangling each other at the middle portion. In addition, the other ends 102*b* and 103*b* of the coil springs 102 and 103 are prevented from scratching the inner wall of the development tank 20 even when the coil springs 102 and 103 are provided in contact with the inner wall of the development tank 20.

Figure 15:
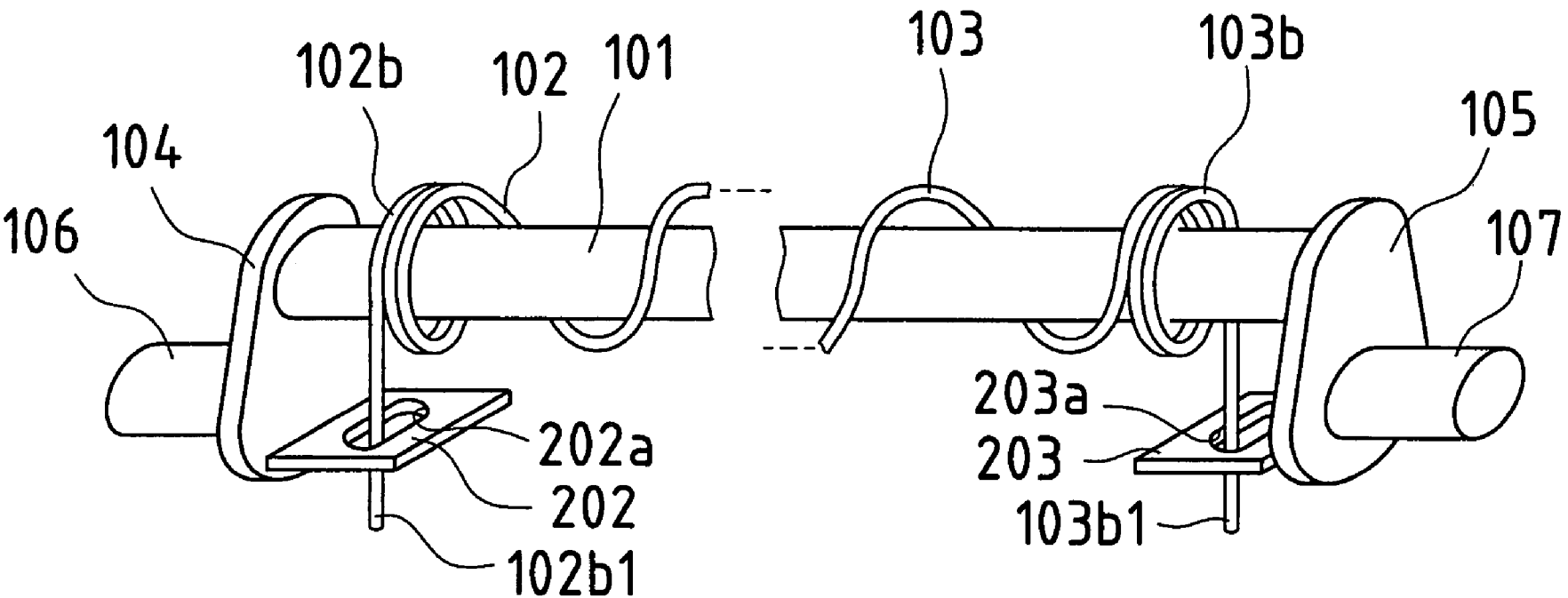

FIG. 15 is an enlarged perspective view illustrating the outer end portions 102*b* and 103*b* of the separate coil springs 102 and 103.

The outer end portions 102*b* and 103*b* of the separate coil springs 102 and 103 are projected in an outward direction perpendicular to a center axis of the stainless steel shaft 101 (downward in FIG. 15). Also, projected tip portions 102*b*1 and 103*b*1 of the outer end portions 102*b* and 103*b* are inserted through long holes 202*a* and 203*a* formed on engagement plates 202 and 203 provided on the rotation support members 104 and 105. The long holes 202*a* and 203*a* are elongated along a rotational direction of the separate coil springs 102 and 103. The separate coil springs 102 and 103 can be rotated with a predetermined angle which is limited by the length of the long holes 202*a* and 203*a*, respectively. The long holes 202*a* and 203*a* are wider than outer diameters of the projected tip portion 102*b*1 and 103*b*1, respectively. Therefore, the outer end portions 102*b* and 103*b* of the separate coil springs 102 and 103 can be moved in a thrust direction by a predetermined length limited by widths of the long holes 202*a* and 203*a*, respectively.

As indicated with a dash-dot line in FIG. 13 , the separate coil springs 102 and 103 contact with an inner wall surface 20*a* of the development tank 20 when being rotated around the stainless steel shaft 101. Thus, the separate coil springs 102 and 103 contact with the inner wall surface 20*a* and are therefore forcibly moved in the radial direction, resulting in an effect of further loosening compaction of toner.

As illustrated in FIG. 14, a drive transfer member 27 is provided at an end portion of the rotational axis 107 (a right-hand end portion in FIG. 14). The drive transfer member 27 has a clutch structure which can be engaged and disengaged and can transfer external force (rotational force) to the rotational axis 107 of the stainless steel shaft 101. The drive transfer member 27 includes a disk-like rotated plate 25 attached to the rotational axis 107, and a disk-like transfer rotating plate 26 transferring external force (not shown).

In the thus-constructed auger conveyor member, second coil springs 302 and 303 are further provided near the outer end portions of the separate coil springs 102 and 103, facing and paralleling to the separate coil springs 102 and 103, respectively, in Example Embodiment 4 (see FIG. 14). The second coil springs 302 and 303 can be moved in a thrust direction and in a radial direction, as with the separate coil springs 102 and 103.

Specifically, the second coil springs 302 and 303 are each disposed between a pair of holding plates 310 and 310 which are provided on the internal wall surface of the development tank 20, facing each other via a predetermined interval. Both end portions of the second coil springs 302 and 303 are inserted around holding projected portions 311 and 311 which are provided on surfaces facing each other of the holding plates 310 and 310. Inner diameters of the second coil springs 302 and 303 are larger than an outer diameter of the holding projected portion 311. Lengths of the second coil springs 302 and 303 are smaller than a distance between the pair of the holding plates 310 and 310. Therefore, the second coil springs 302 and 303 inserted around both ends of the pair of the holding projected portions 311 and 311 can be moved in a thrust direction and in a radial direction with respect to the holding projected portion 311.

The second coil springs 302 and 303 are disposed to contact with the stainless steel shaft 101 and/or the separate coil springs 102 and 103 when the stainless steel shaft 101 is rotated. In addition, the second coil springs 302 and 303 have winding directions opposite to the separate coil springs 102 and 103, respectively. With such an arrangement of the second coil springs 302 and 303, an effect of further loosening compaction of a toner is obtained, thereby making it possible to stably convey the toner.

Note that the coil springs 102, 103, 302, and 303 are constructed to satisfy:

$$D/2<P \tag{1}$$

where P (mm) represents a helical pitch thereof and D (mm) represents an outer diameter thereof.

When the above-described relationship is satisfied, it is possible to increase the amount of conveyed toner and suppress the developer from attaching to a coil spring.

Next, a specific example of the developer detecting mechanism section of Example Embodiment 4 will be described.

The developer detecting mechanism section is in the shape of a crank, in which a stainless steel shaft 101 (outer diameter: 5 mm) is fixed to rotation support members 104 and 105 and is deviated by 6 mm from a center of drive rotation R. Two separate coil springs 102 and 103 each having a wire diameter of 0.5 mm, an outer diameter of 7 mm, and a helical pitch (P) of 8 mm are inserted around the stainless steel shaft 101. The separate coil spring 102 is right-hand wound, while the separate coil spring 103 is left-hand wound.

End portions of the separate coil springs 102 and 103 have a total of clearances of about 5 mm [≅L1−(L2+L3)] so that the separate coil springs 102 and 103 can be independently moved freely by 1 mm in a radial direction and by about 4 mm in a thrust direction.

Thus, since the coil springs 102 and 103 can be moved in the radial direction, a toner which is present around the helix and may cause compaction is removed by rotation without retention. Therefore, adverse effects, such as packing and compaction, can be prevented, thereby making it possible to achieve a highly reliable development operation. If the stainless steel shaft 101 is not provided, the coil springs 102 and 103 are bent and deformed due to load of a toner in association with rotation drive, so that the separate coil springs 102 and 103 may contact with an inner wall of a housing (not shown), leading to a failure. In contrast, with the above-described structure, the stainless steel shaft 101 limits the deformation, thereby making it possible to achieve a highly reliable operation. In addition, since the separate coil springs 102 and 103 are wounded in opposite directions, the developer in the development tank is, for example, transferred from both the ends to the middle portion as if the developer were collected together, so that the powder pressure of the developer in the development tank is made uniform and the developer is consistently made flat. Therefore, it is possible to maintain satisfactory image quality and detect the remaining amount of the developer with high precision without occurrence of a detection error which is a problem with conventional techniques.

On the other hand, the second coil springs 302 and 303 each have an outer diameter of 12 mm, a wire diameter of 0.8 mm, and a helical pitch (P) of 8 mm, so that the second coil springs 302 and 303 can be moved by 6 mm in a radial direction and by 3 mm in a thrust direction with respect to the holding projected portion 311. The second coil spring 302 facing the right-hand wound separate coil spring 102 is left-handed wound, and the second coil spring 303 facing the left-hand wound separate coil spring 103 is right-hand wounded.

With such a structure and an arrangement of the second coil springs 302 and 303, a toner attached to a corner of the development tank 20 can be effectively loosened. In addition, by using the eccentric stainless steel shaft 101 and separate coil springs 102 and 103, a toner can be more stably conveyed.

Example Embodiment 5

As described above, the development apparatuses of the above-described examples can improve the detection precision of the remaining amount of a developer. However, there are problems with these development apparatuses in terms of other points described below.

As illustrated in FIG. 2, in the developer detecting mechanism section, the auger conveyor roller 24 of FIG. 4 and the coil springs 102 and 103 of FIG. 11 are disposed above and near the toner supplying roller 22. In this case, when the auger conveyor roller 24 of FIG. 4 and the coil springs 102 and 103 of FIG. 11 are excessively close to the toner supplying roller 22, a toner is not uniformly distributed because of a relationship between the roller pitch (helical pitch) of the auger conveyor roller 24 and the helical pitch of the coil springs 102 and 103, resulting in a new problem, i.e., occurrence of irregular image density.

Concerning this problem, the present inventors conducted experiments so as to determine how close the toner supplying roller 22 is to the coil springs 102 and 103 (i.e., to what degree a gap (clearance) P between the toner supplying roller 22 and the coil springs 102 and 103 is reduced (see FIG. 2)) when irregular image density occurs. The experiment was conducted under five conditions described in Table 1 below.

TABLE 1

| | clearance P(mm) | | | | |
|---|---|---|---|---|---|
| | 1.2 | 1.3 | 1.6 | 2.1 | 2.6 |
| condition (mm) | axis: ϕ5.2<br>spring: outer diameter ϕ8<br>wire diameter ϕ0.4<br>clearance between inner diameter and spring: 1.00 | axis: ϕ5.5<br>spring: outer diameter ϕ8<br>wire diameter ϕ0.4<br>clearance between inner diameter and spring: 0.85 | axis: ϕ6<br>spring: outer diameter ϕ8<br>wire diameter ϕ0.4<br>clearance between inner diameter and spring: 0.6 | axis: ϕ5<br>spring: outer diameter ϕ7<br>wire diameter ϕ0.4<br>clearance between inner diameter and spring: 1.1 | axis: ϕ4<br>spring: outer diameter ϕ6<br>wire diameter ϕ0.4 |
| irregular image density | X | X | X | Δ | ○ |

○ . . . no
Δ . . . some
X . . . significant

As a result, it was confirmed that when the clearance P is smaller than or equal to about 2 mm, irregular image density occurs; and when the clearance P is larger than or equal to about 2 mm, irregular image density does not occur. Note that the clearance P (2 mm) may vary to some degree, depending on the spring diameter or the like of the coil springs 102 and 103. The five conditions of Table 1 are directed to practically used apparatuses. Therefore, for practically used apparatuses, it was confirmed that the threshold of occurrence of irregular image density is about 2 mm.

Next, Example Embodiment 5 which can improve the detection precision of the remaining amount of developer and solve the above-described new problem will be described with reference to the accompanying drawings. In Example Embodiment 5, a development apparatus having a form different from that of Example Embodiment 1 will be described with reference to the accompanying drawings. Note that, in the development apparatus of Example Embodiment 5, the same parts as those of the development apparatus 2 of Example Embodiment 3 are indicated with the same reference numerals, and if the configuration of the same parts are the same, the description thereof will be omitted, and different configurations will be described. A function and an effect different from those of Example Embodiment 3 will be described, and the same function, effect, and variation will not be explained.

Explanation of Development apparatus of Example Embodiment 5

Figure 16:
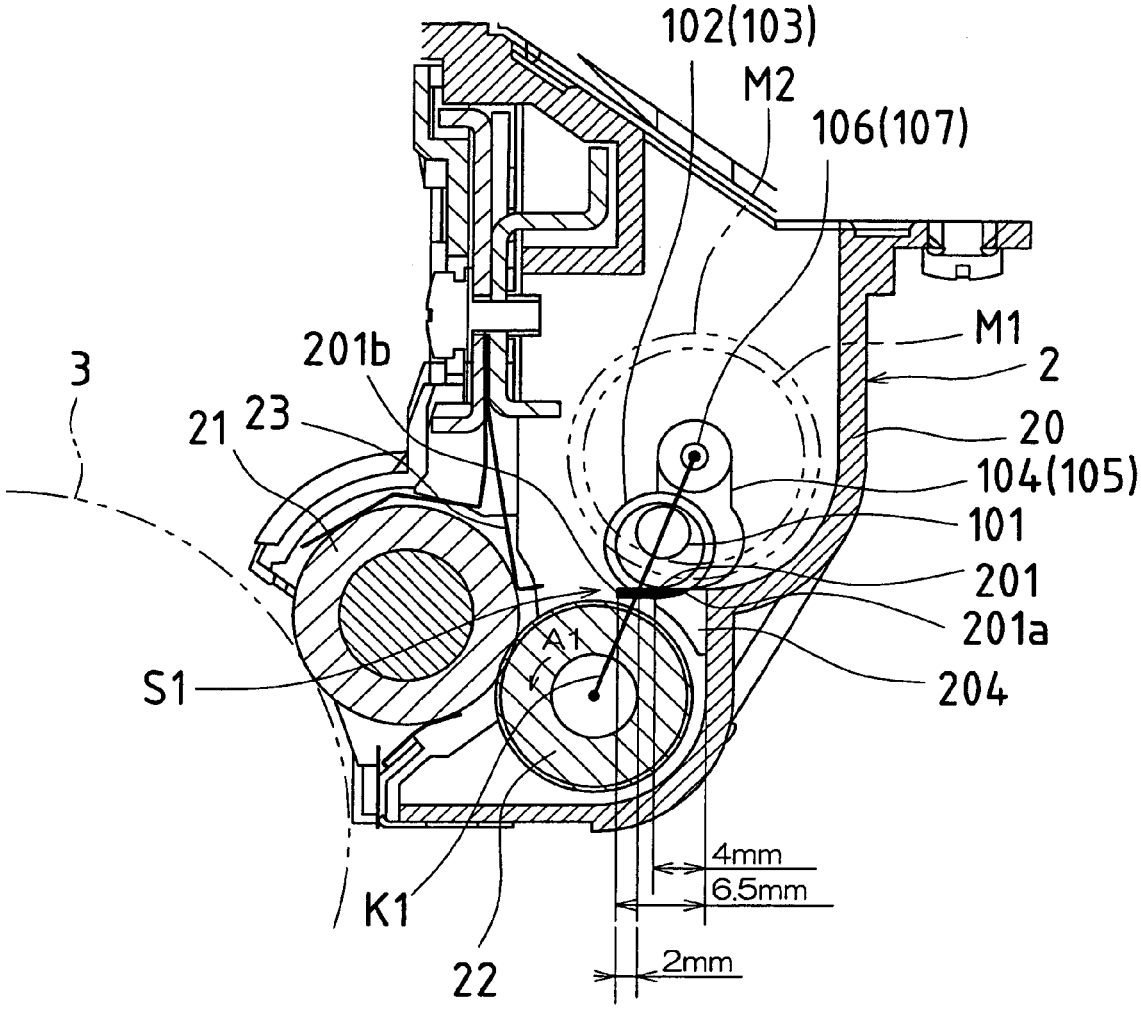
FIG. 16 is an enlarged cross-sectional view schematically illustrating a development apparatus according to Example Embodiment 5
Figure 17:
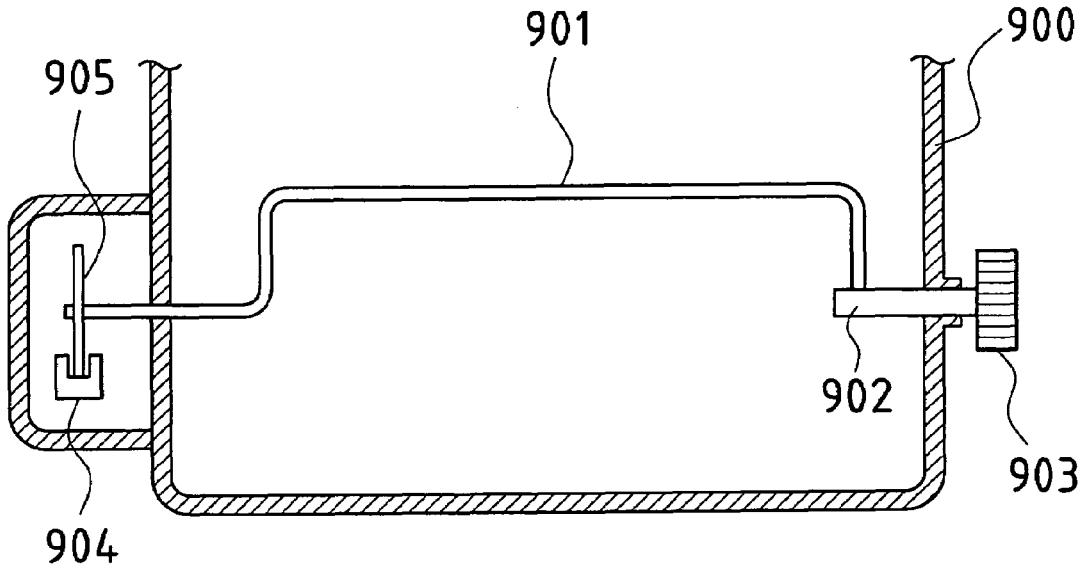
FIG. 17 is a diagram for explaining an exemplary developer detecting mechanism section of a conventional development apparatus.

FIG. 16 is an enlarged cross-sectional view schematically illustrating the development apparatus 2 of Example Embodiment 5.

A basic structure of the development apparatus 2 of Example Embodiment 5 is similar to those of the development apparatuses 2 of Examples 1 to 4. A characteristic structure of the development apparatus 2 of Example Embodiment 5 is illustrated in FIG. 16. Note that a reference numeral 104 (105) in FIG. 16 indicates a rotation support member. A reference numeral 106 (107) indicates a rotational axis for rotating the stainless steel shaft 101 itself (also see FIG. 11). A trajectory Ml indicated with a dash-dot-dot line in FIG. 16 indicates a rotational trajectory of an outermost circumference of the stainless steel shaft 101 . A trajectory M2 indicates a rotational trajectory of an outermost circumference of the coil springs 102 and 103 when the coil springs 102 and 103 are in contact with the stainless steel shaft 101 .

In the above-described structure of Example Embodiment, a uniforming member 201 for making toner uniform (filled with black in FIG. 16 ) is provided in a space portion S1 between the toner supplying roller 22 and the coil springs 102 and 103 constituting an auger conveyor member.

In Example Embodiment 5, the uniforming member 201 is made of a thin-plate-like elastic film (e.g., specifically, polyethylene terephthalate). Since the uniforming member 201 is made of the elastic film, the film can be deformed, depending on the pressure toner, thereby making it possible to prevent attachment of melted toner due to an abnormal increase in pressure of partial toner and a non-uniform toner charge amount. According to a result of experiments, it was confirmed that a thickness t (mm) of the elastic film of polyethylene terephthalate is preferably in the range of 0.1 mm $\leqq t \leqq 0.5$ mm in terms of elastic deformation.

An end portion 201*a* of the uniforming member 201 is supported and fixed via a fixing rib 204 to an inner wall of the development tank 20 upstream in a roller rotational direction (direction A1 in FIG. 16) from the toner supplying roller 22. In addition, the other end portion 201*b* of the uniforming member 201, which is located downstream in the roller rotational direction A1, is a free end. Thus, the uniforming member 201 is supported and fixed at only one end, so that the other end portion 201*b* can be freely swung upward and downward, resulting in a more stable uniforming operation.

In this case, the other end portion 201*b* (free end) of the uniforming member 201 is located on a straight line K1 between a center of roller rotation of the toner supplying roller 22 and a center of rotation of the rotational axis 106 (107) (i.e., a center of drive rotation of the auger conveyor member) or downstream in the roller rotational direction μl from the straight line K1.

Specifically, the uniforming member 201 is horizontally disposed, projecting by about 2.5 mm from a tip portion of the fixing rib 204. Specifically, a supporting side portion of the fixing rib 204 supporting the uniforming member 201 has a length of about 4 mm as measured from the inner wall surface of the development tank 20. Therefore, a distance from the inner wall surface of the development tank 20 to the other end portion 201*b* of the uniforming member 201 is about 6.5 mm. Also, the uniforming member 201 is projected by about 2 mm toward downstream in the roller rotational direction A1 from the straight line K1. Thus, the other end portion 201*b* of the uniforming member 201 is provided projecting toward downstream in the roller rotational direction A1 to some extent, thereby making it possible to achieve a more stable uniforming operation.

In addition, a surface of the uniforming member 201 may be conferred a releasing ability by, for example, coating with PTFE film or fluorocarbon resin coating, or alternatively, plating with nickel-PTFE composite. Thereby, melted toner can be prevented from being attached to a surface of the uniforming member 201.

The effect of Example Embodiment 5 can be exhibited to a further extent by applying Example Embodiment 5 to a development apparatus which is not provided with a replenishing roller for controlling the supply amount of toner in the development tank 20. When a toner is made of a single non-magnetic component, the effect of the development apparatus of Example Embodiment 5 is exhibited to a further extent. Although a two-component developer including a carrier can prevent blocking of the developer due to the carrier, the function and effect of the uniforming member 201 in the development apparatus of Example Embodiment 5 are more effectively exhibited when a toner is made of a single non-magnetic component.

Next, a specific example of a developer detecting mechanism section according to Example Embodiment 5 will be described.

In Example Embodiment 5, the developer detecting mechanism section is in the shape of a crank, in which a stainless steel shaft 101 (outer diameter: 4 mm) is supported and fixed to rotation support members 104 and 105 and is deviated by 6 mm from a center of drive rotation. Two coil springs 102 and 103 each having a wire diameter of 0.8 mm, an outer diameter of 8 mm, and a helical pitch (P) of 8 mm are inserted around the stainless steel shaft 101. Note that it is assumed that the coil spring 102 is right-hand wound, while the coil spring 103 is left-hand wound.

A spring length L2 of the coil spring 102 and a spring length L3 of the coil spring 103 have a clearance of about 5 mm [$\cong$L1−(L2+L3)] with respect to an effective length L1 of the stainless steel shaft 101. Therefore, the coil springs 102 and 103 can be independently moved freely in a radial direction and in a thrust direction.

Further, the coil spring 102 and the coil spring 103 are tightly wound at both ends 102*a* and 102*b* and both ends 103*a* and 103*b* thereof. The end portions 102*a* and 103*a* of the coil springs 102 and 103 are prevented from accidentally entangling each other at the middle portion. In addition, the other ends 102*b* and 103*b* are prevented from scratching the inner wall of the housing when the coil springs 102 and 103 are slid to rub the inner wall of the housing.

When the toner supplying roller 22 is closest to the coil springs 102 and 103, there may be a clearance of 1.6 mm. As the uniforming member 201, a PET film having a thickness of 0.1 mm may be used. An upstream end portion 201*a* of the PET film may be adhered and fixed to an inner wall of the development tank 20 using a double-sided tape, and a downstream end portion 201*b* may be projected in an amount of X (=2 mm).

When the thus-constructed development apparatus was mounted on an image forming apparatus to form an image, a satisfactory image without irregular image density could be obtained.

The present invention can be embodied and practiced in other different forms without departing from the gist and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A development apparatus comprising:

an auger conveyor member configured to stir and convey developer, whereby developer may be eccentrically distributed with respect to a center of rotation of the auger conveyor member;

a drive transfer member configured to drive and rotate the auger conveyor member, wherein the drive transfer member can be engaged and disengaged; and an auger conveyor member rotational state detector, configured to detect an amount of the developer based on a rotational state of the auger conveyor member; and wherein the rotational state detector is configured to generate a plurality of output pulses per cycle of rotation of the auger conveyor member.

2. The development apparatus according to claim 1, further comprising one or more second auger conveyor members, wherein the second auger conveyor member is different from the auger conveyor member.

3. The development apparatus according to claim 2, wherein the second auger conveyor member is configured to stir and convey the developer in a direction opposite to an auger conveyor direction of the auger conveyor member.

4. The development apparatus according to claim 1, wherein the auger conveyor member is provided above a development supply roller.

5. The development apparatus according to claim 1, wherein the auger conveyor member is configured to stir and convey the developer from ends of the auger conveyor member toward a middle portion of the auger conveyor member.

6. A development apparatus comprising:

an auger conveyor member configured to stir and convey developer whereby developer may be eccentrically distributed with respect to a center of rotation of the auger member; and a drive transfer member configured to drive and rotate the auger conveyor member;

wherein the auger conveyor member is provided near a development supply roller, and a developer uniforming member is provided in a space portion between the development supply roller and the auger conveyor member.

7. The development apparatus according to claim 6, wherein a developer replenishing roller is not provided in a development tank.

8. The development apparatus according to claim 6, further comprising an auger conveyor member rotational state detector configured to detect an amount of developer based on a rotational state of the auger conveyor member.

9. The development apparatus according to claim 6, wherein the developer is made of a single non-magnetic component.

10. The development apparatus according to claim 6, wherein one end portion of the developer uniforming member is fixed to and supported by an inner wall of a development tank upstream in a roller rotational direction of the development supply roller, and another end portion of the developer uniforming member is not fixed to or supported by any other structure.

11. The development apparatus according to claim 10, wherein said another end portion of the developer uniforming member is located on a straight line between a center of roller rotation of the development supply roller and a center of drive rotation of the auger conveyor member, or downstream in a roller rotational direction from the straight line.

12. The development apparatus according to claim 6, wherein the developer uniforming member comprises an elastic film.

13. The development apparatus according to claim 12, wherein the elastic film comprises polyethylene terephthalate.

14. The development apparatus according to claim 6, wherein a surface of the developer uniforming member has a releasing ability.

15. The development apparatus according to claim 6, wherein the auger conveyor member is provided above the development supply roller.

16. The development apparatus according to claim 6;

wherein the eccentric distribution of developer is achieved by a rod-like weight member eccentrically provided with respect to a rotational axis of the auger conveyor remember;

wherein the auger conveyor member comprises a helical member having an inner diameter larger than an outer diameter of the weight member; and wherein the helical member is rotatably positioned around the weight member.

17. A development apparatus comprising:

an auger conveyor member stir and convey developer, whereby developer may be eccentrically distributed with respect to a center of rotation of the auger conveyor member;

a drive transfer member configured to drive and rotate the auger conveyor member. wherein the drive transfer member can be engaged and disengaged; and an auger conveyor member rotational state detector, configured to detect an amount of the developer based on a rotational state of the auger conveyor member; and wherein the eccentric distribution of developer is achieved by a rod-like weight member eccentrically provided with respect to a rotational axis of the auger conveyor member, the auger conveyor member comprises a helical member having an inner diameter larger than an outer diameter of the weight member, and the helical member is rotatably positioned around the weight member.

18. The development apparatus according to claim 17, wherein the helical member is a coil spring.

19. The development apparatus according to claim 17, wherein the helical member comprises a plurality of separate members having different winding directions.

20. The development apparatus according to claim 19, wherein the helical member is positioned around the weight member, leaving a clearance which allows the helical member to be moved in a thrust direction.

21. The development apparatus according to claim 20, wherein each of the plurality of separate members of the helical member is tightly wound at ends thereof.

22. A development apparatus comprising:

an auger conveyor member configured to stir and convey developer whereby developer may be eccentrically distributed with respect to a center of rotation of the auger conveyor member;

a drive transfer member configured to drive and rotate the auger conveyor member wherein the drive transfer member can be engaged and disengaged;

wherein eccentric distribution of developer is achieved by a rod-like weight member eccentrically provided with respect to the rotational axis of the auger conveyor member;

wherein the auger conveyor member includes a first coil spring having an inner diameter larger than an outer diameter of the weight member; and wherein the first coil spring is positioned around the weight member in a manner which allows the first coil spring to be rotated to a predetermined angle.

23. The development apparatus according to claim 22, further comprising a weight member rotational state detector, whereby an amount of developer may be detected based on a rotational state of the weight member.

24. The development apparatus according to claim 22, wherein the first coil spring can be moved in a radial direction with respect to the weight member by an amount corresponding to a difference between the outer diameter of the weight member and the inner diameter of the first coil spring.

25. The development apparatus according to claim 24, wherein the first coil spring can be moved in a thrust direction with respect to the weight member.

26. The development apparatus according to claim 22, wherein the first coil spring comprises two separate coil springs having different winding directions.

27. The development apparatus according to claim 26, wherein the two separate coil springs are positioned around the weight member, leaving a predetermined clearance between opposing end portions of the two separate coil springs.

28. The development apparatus according to claim 26, wherein an outer end portion of each separate coil spring projects in a direction perpendicular to a center axis of the weight member, the projected outer end portion is positioned at least in part within a long hole provided in an engagement plate provided in the weight member, and the separate coil spring can be rotated by a predetermined angle limited by the long hole.

29. The development apparatus according to claim 22, wherein a separate coil spring is positioned to contact an inner wall surface of a development tank when the weight member is rotated.

30. The development apparatus according to claim 22, wherein a second coil spring is provided near an outer end portion of the first coil spring, wherein said second coil spring is parallel to the first coil spring; and wherein the second coil spring can be moved in a thrust direction and in a radial direction.

31. The development apparatus according to claim 30, wherein the second coil spring is positioned a round a pair of holding projected portions provided on an inner wall surface of a development tank, in a manner which allows free play of ends of the second coil spring.

32. The development apparatus according to claim 30, wherein the second coil spring is positioned to contact the weight member and/or the first coil spring when the weight member is rotated.

33. The development apparatus according to claim 30, wherein the second coil spring is wound in a direction opposite to a winding direction of the first coil spring.

34. The development apparatus according to claim 22, wherein the coil spring is formed to satisfy:

$$D/2<P$$

where a helical pitch thereof is represented by P (mm) and an outer diameter thereof is represented by D (mm).

* * * * *